US012285111B1

(12) United States Patent
Haines et al.

(10) Patent No.: US 12,285,111 B1
(45) Date of Patent: Apr. 29, 2025

(54) MODULAR MATTRESS SYSTEM AND METHOD

(71) Applicant: SENIAH Innovations Group, LLC, Austin, TX (US)

(72) Inventors: Charles M Haines, Calgary (CA); Charles R B Haines, Calgary (CA); Brandon J Bain, Katy, TX (US); Stephen M Ferguson, Katy, TX (US)

(73) Assignee: SENIAH Innovations Group, LLC, Austin, TX (US)

( * ) Notice: Subject to any disclaimer, the term of this patent is extended or adjusted under 35 U.S.C. 154(b) by 0 days.

(21) Appl. No.: 18/593,598

(22) Filed: Mar. 1, 2024

Related U.S. Application Data

(60) Provisional application No. 63/610,782, filed on Dec. 15, 2023.

(51) Int. Cl.
*A47C 27/14* (2006.01)
*A47C 27/00* (2006.01)
*A47C 27/15* (2006.01)

(52) U.S. Cl.
CPC ..... *A47C 27/001* (2013.01); *A47C 27/148* (2013.01); *A47C 27/15* (2013.01)

(58) Field of Classification Search
CPC ..... A47C 27/001; A47C 27/14; A47C 27/148; A47C 27/15
See application file for complete search history.

(56) References Cited

U.S. PATENT DOCUMENTS 3,521,311 A * 7/1970 Cohen ..... A47C 27/15 5/727
5,960,496 A * 10/1999 Boyd ..... A47C 27/18 5/931
9,974,394 B2 5/2018 Brykalski et al.
10,766,761 B2 9/2020 Kojima et al.
10,889,071 B2 1/2021 Kojima et al.
11,241,100 B2 2/2022 Chapin et al.
(Continued)

FOREIGN PATENT DOCUMENTS

JP 6917609 B2 8/2021
JP 2021171239 A 11/2021
(Continued)

OTHER PUBLICATIONS

Airweave Website—Advanced Mattress (May 3, 2024) https://airweave.com/products/advanced-mattress.
(Continued)

*Primary Examiner* — Justin C Mikowski
*Assistant Examiner* — Ifeolu A Adeboyejo
(74) *Attorney, Agent, or Firm* — Loveless Law Group; Ryan Loveless

(57) ABSTRACT

As per an embodiment of the disclosure, a minimum of one module is modularized in one of the following mattress layer: comfort, contour, or support. This modularization entails at least one module per side of the mattress. In particular configurations, all modules within a respective layer may have an identical size in length, width, and height. In other configurations, two modules within a respective layer may be larger or smaller than the other modules. For example, in the contour layer, the hip module on both the left and right sides of the mattress may be larger than the head and foot modules.

26 Claims, 21 Drawing Sheets

(56) References Cited

U.S. PATENT DOCUMENTS

| | | | | |
|---|---|---|---|---|
| 11,540,642 | B2 | 1/2023 | Brosnan et al. | |
| 2005/0210595 | A1* | 9/2005 | Di Stasio | A47C 21/046 5/690 |
| 2008/0098533 | A1* | 5/2008 | Erdman | A47C 27/001 5/722 |
| 2008/0201856 | A1* | 8/2008 | Howard | A47C 31/123 5/690 |
| 2013/0161858 | A1 | 6/2013 | Sasaki | |
| 2013/0269114 | A1* | 10/2013 | Wu | A47C 27/001 5/723 |
| 2014/0082843 | A1* | 3/2014 | Papadakos | A47C 23/34 5/613 |
| 2014/0283305 | A1* | 9/2014 | Zysman | A47C 27/148 5/636 |
| 2015/0082550 | A1* | 3/2015 | Hui | A47C 27/001 5/727 |
| 2015/0296993 | A1* | 10/2015 | Boyd | A47C 27/001 5/724 |
| 2016/0088951 | A1* | 3/2016 | McGuinness | A47C 3/16 5/35 |
| 2017/0224126 | A1* | 8/2017 | O'Connell, Jr. | A47G 9/10 |
| 2017/0325596 | A1* | 11/2017 | Torbet | A47C 27/14 |
| 2019/0125092 | A1 | 5/2019 | Ando et al. | |
| 2019/0298078 | A1* | 10/2019 | Vester, III | A47C 27/001 |
| 2021/0244197 | A1* | 8/2021 | Oswald | A47C 31/123 |
| 2022/0039560 | A1* | 2/2022 | Roma | A47C 27/144 |

FOREIGN PATENT DOCUMENTS

| | | | |
|---|---|---|---|
| JP | 2022138023 | A | 9/2022 |
| JP | 2022069693 | B | 11/2023 |
| WO | 2023008110 | A1 | 2/2023 |

OTHER PUBLICATIONS

Airweave Website—Mattress 70 (May 3, 2024) https://airweave.com/products/mattress-70.

Bedgear Website (May 3, 2024) https://www.bedgear.com/shop/mattresses.

Custom X Comfort Mattress Website (May 3, 2024) https://customcomfortmattress.com/.

Diamond Mattress Website (May 3, 2024) https://diamondmattress.com/pages/autopilot.

Evred website (May 3, 2024) https://evrbed.com.

Isense Website (May 3, 2024) https://www.myisense.com/.

King Koil (Smart Life) Website (May 3, 2024) https://www.kingkoil.com/collections/smartlife/featured-product-p-752/.

Naturepedic Website (May 3, 2024) https://www.naturepedic.com/learn/adult/customize.

Obasan Website (May 3, 2024) https://obasan.com/.

Personal Comfort Website (May 3, 2024) https://personalcomfortbed.com/.

Sleep Mattress Website (May 3, 2024) https://www.sleepnumber.com/categories/mattresses.

Sleep to Live by Kingsdown Website (May 3, 2024) https://kingsdown.com/product/kingsdown-sleep-to-live/.

Sterling Sleep System Website (May 3, 2024) https://sterlingsleep.com/.

* cited by examiner

MODULAR MATTRESS SYSTEM AND METHOD

REFERENCE TO RELATED APPLICATIONS

This application claims priority to Provisional Application No. 63/610,782 filed on Dec. 15, 2023, which is hereby incorporated by reference in its entirety.

FIELD OF THE INVENTION

This disclosure is generally directed to mattress systems. More specifically, this disclosure is directed to a modular mattress system, and the selection and assembly processes.

BACKGROUND OF THE DISCLOSURE

Mattresses have evolved with the advent of new materials and technologies. However, difficulties exist with accommodating the fact that not everyone is built the same and has the same preferences, leading to sleep partners having to compromise on comfort. Similarly, with the evolution and introduction of new materials and technologies in the mattress and bedding industry, consumers often find themselves needing to prohibitively purchase an entirely new mattress to experience any of these benefits.

SUMMARY OF THE DISCLOSURE

The disclosure offers a method and system for modularizing mattresses in light of the deficiencies delineated herein. As per an embodiment of the disclosure, a minimum of one module is modularized in one of the following mattress layer: comfort, contour, or support. This modularization entails at least one module per side of the mattress. In particular configurations, all modules within a respective layer may have an identical size in length, width, and height. In other configurations, two modules within a respective layer may be larger or smaller than the other modules. For example, in the contour layer, the hip module on both the left and right sides of the mattress may be larger than the head and foot modules.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. When used with a list of items, the phrase "at least one of," means that different combinations of one or more of the listed items may be used, and only one item in the list may be needed. For example, "at least one of A, B, and C" includes any of the following combinations: A; B; C; A and B; A and C; B and C; and A and B and C. Definitions for certain words and phrases are provided throughout this patent document, those of ordinary skill in the art should understand that in many if not most instances, such definitions apply to prior, as well as future uses of such defined words and phrases.

BRIEF DESCRIPTION OF DRAWINGS

For a more complete understanding of this disclosure and its features, reference is now made to the following description, taken in conjunction with the accompanying drawings in which.

DETAILED DESCRIPTION

The Figures described below, and the various embodiments used to describe the principles of the present disclosure in this patent document are by way of illustration only and should not be construed in any way to limit the scope of the disclosure. Those skilled in the art will understand that the principles of the present disclosure invention may be implemented in any suitably arranged device or system. Additionally, the drawings are not necessarily drawn to scale.

Figure 1:
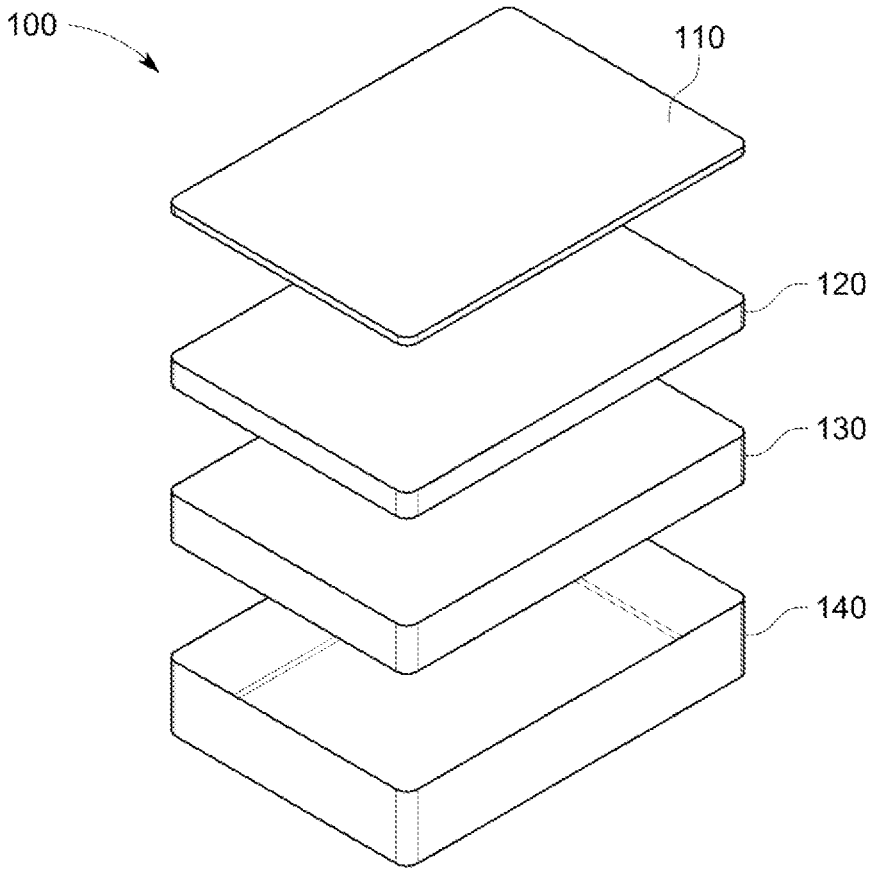
FIG. 1 provides a high-level overview of a mattress system for understanding embodiments of the disclosure.

FIG. 1 provides a high-level overview of a mattress system 100 for understanding embodiments of the disclosure. The mattress system 100 includes three layers: 110, 120, and 130. As described herein, the mattress system can be individually customized per side. This gives both sleepers (also referred to as sleep partners, users, couples, consumers, customers, etc.) a personalized sleep experience with a mattress tailored to their body type and sleeping preferences. While three layers will be described concerning certain configurations, others may have more than or less than three layers. Additionally, as described below, specific layers may have sub-layers.

The top layer 110 of the mattress system 100 is often called the comfort layer. This layer is the part of the mattress that the body comes in contact with. The comfort layer can have various firmness levels, including, but not limited to, soft, medium, or firm. The variance in firmness can be achieved through different techniques such as the quilting pattern (see, e.g., FIG. 6), the material type and composition of the comfort layer, or by adding or removing modular layers within the dual-zip pouch(es). In other configurations, another technique can be used to achieve a different feel and/or firmness with the same comfort layer. By flipping the comfort layer on its x-axis (so the bottom side is now facing upwards), the consumer's body would come in contact with a different internal material that is enclosed within the same comfort layer. As a non-limiting example, the top side of the comfort layer could be comprised of wool, while the bottom side could be a gel grid or gel-infused memory foam. One benefit to this specific example is temperature regulation. By sleeping with the wool side closest to the body, the user is taking advantage of the wool's insulating properties, resulting in a warmer sleeping environment. Alternatively, by sleeping with the gel grid side closest to the body, the user is taking advantage of the gel grid's properties of improved airflow, resulting in a milder sleeping environment when compared to the former. In particular configurations, the top layer 110 may have a fastener (such as a zipper) located around the outside tapeline, allowing it to attach to a box 140, often referred to as a eurobox, box, or bucket. In other configurations, other types of fasteners may be used to attach the top layer 110 to the box 140. And, in yet different configurations, the top layer 110 may not connect to the box and/or may not use fasteners. While the top layer is attached to portions of a eurobox at a particular location in this figure, the top layer can also attach at different locations in other configurations. As a non-limiting example, in particular configurations, the top layer can attach to the side of the eurobox. One such example is shown with reference to FIGS. 18A-18E.

In particular configurations, the top layer 110 may contain multiple layers collectively called the top layer 110 or comfort layer. Non-limiting examples of materials for the comfort layer include but are not limited to, polyfoam, memory foam, latex, and fibers. The fibers may be cotton, wool, polyester, or a combination of the preceding. Further non-limiting examples of details of the top layer are described with reference to FIGS. 6 and 14A, 14B, 14C, 14D, 18A, 18B, 18C, and 18D.

The middle layer 120 of the mattress is often called the contour layer. This layer can be a material type such, as but not limited to memory foam, pocket coils, polyurethane foam, or organic latex. This layer's firmness can be but is not limited to soft, medium, firm, or extra firm.

The bottom layer 130 of the mattress is often called the support layer. This layer can be any of a variety of types of materials, such as, but not limited to, memory foam, pocket coils, polyurethane foam, or organic latex. This layer's firmness can be but is not limited to soft, medium, firm, or extra-firm.

In particular configurations described herein, modules in the middle layer 120 and bottom layer 130 can be placed in a sleeve that can have a locking zipper. The locking zipper (or other similar locking mechanism) prevents a customer from opening the sleeve. Inside the sleeve, the raw material module can be wrapped in materials such as wool, kapok, down feathers, and the like. Alternatively, the sleeve could be quilted and contain those materials. As a non-limiting example, the module's sleeve may have a fastener (such as a zipper, clasp, hook and loop fastener, etc.) that allows the other modules within the mattress system to attach together. This feature could improve structure and reduce movement of the modules.

The box 140 is a container in which the middle layer 120 and bottom layer 130 are enclosed. In particular configurations, the zipper that attaches the top layer 110 to the box 140 is universal, meaning any top layer 110 can connect to any box 140, allowing the consumer to use a different top layer with the same original box. While a box is shown in particular configurations, a box may not be used in other configurations.

In particular configurations, the mattress system 110 may have a dual-zip technology or design where a minimum of one pouch, pocket, sleeve, or the like exists under the top layer 110. In particular configurations, as shown with reference to FIGS. 14A-14D, the pouch, pocket, sleeve, or the like is sewn into the bottom of the comfort layer. Non-limiting examples of the top layers are shown with reference to FIG. 6. The mattress can have a material type such as but not limited to memory foam, pocket coils, polyurethane foam, or organic latex, inserted into the pouch, pocket, or sleeve. The materials inserted into the dual-zip pouch can have a firmness, including, but not limited to, soft, medium, or firm. Non-limiting examples of multiple modular materials, layers, and/or modules (e.g., 1415A' & 1415B' of FIG. 14D) can be placed within the same pouch and placed on top of one another. In some configurations, individual modules can be comprised of two or more different materials. In a non-limiting example, the top half of the module can be wool while the bottom half can be latex. By simply flipping the module so the bottom is now facing upwards (see, e.g., FIG. 12B), the user can experience a different feel. Changing the firmness and how the mattress feels is only one potential benefit of the modular mattress system. Additional properties and/or characteristics can be achieved such as one side of the module having a cooling characteristic while the other side has a heating characteristic. Further details of one configuration of the dual-zip technology are provided with reference to FIGS. 14A-D. The dual-zip pockets can be zoned and have a modular design like FIG. 3. In particular configurations, dual-zip technology is designed to enhance the performance and feel of the comfort layer/mattress.

In particular configurations, the mattress system 110 may be purchased as a new item from a manufacturer. In other configurations, the modular nature of the components described herein may be considered a retrofit and/or product refresh to existing mattress system designs that maintain specific parts of an existing system. In particular configurations, one or more layers and/or the box may be maintained while one or more are replaced.

Figure 2:
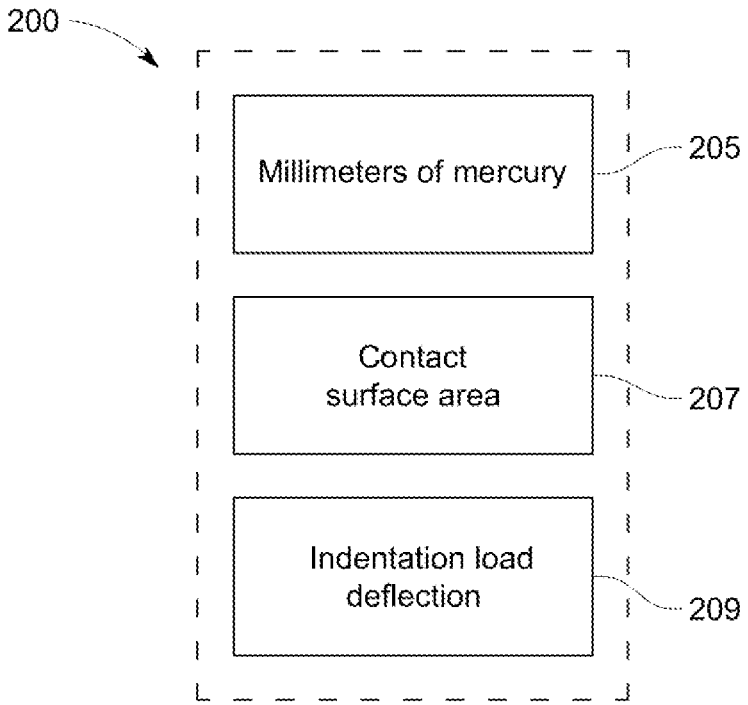
FIG. 2 shows a novel metric system for evaluating mattress components' performance, according to the embodiments of the disclosure.

FIG. 2 shows a novel metric system 200 for evaluating mattress components' performance, according to the embodiments of the disclosure. The system 200, called the Variable Compression Measure (VCM), incorporates three key parameters: Millimeters of Mercury (mmHg) 205, Contact Surface Area (CSA) 207 measured in square centimeters ($cm^2$), and Weight Displacement using Indentation Load Deflection (ILD) 209. While these three parameters are provided and described, other configurations may have only one or two of the parameters described, and other parameters may also be used in different configurations—in addition to the parameters.

The Millimeters of Mercury (mmHg) parameter 205 measures the pressure exerted on the mattress surface during use. By assessing pressure distribution across the mattress, this metric provides valuable insights into localized stress points, enabling a more nuanced understanding of the mattress's conformity to body contours.

The Contact Surface Area (CSA) parameter 207, measured in square centimeters, reflects the compliance or responsiveness of the mattress surface to varying weights. This parameter offers a holistic view of how the mattress accommodates weight, emphasizing the importance of surface compliance in supporting the body uniformly.

The Weight Displacement using Indentation Load Deflection (ILD) parameter 209 measures the firmness of the mattress by quantifying the force required to compress a specific area. As a non-limiting example, the ILD test compresses a sample mattress by 25% of its original height and measures the force required. The higher the ILD value, the firmer the mattress. ILD values typically range from 10 to 80 pounds per square inch (psi), with lower numbers indicating a softer material and higher numbers indicating a firmer material. Below is an example table.

| ILD (psi) | Firmness Level |
|---|---|
| 10-15 | Very soft |
| 15-25 | Soft |
| 25-35 | Medium-soft |
| 35-45 | Medium |
| 45-55 | Medium-firm |
| 55-65 | Firm |
| 65-80 | Very firm |

When integrated into the metric system, ILD contributes to evaluating the mattress's overall support and responsiveness to varying levels of pressure.

The combination of the mmHg parameter 205, the CSA parameter 207, and the Weight Displacement through ILD 209 creates a comprehensive metric system that enhances the accuracy of mattress performance assessment. The collective data offers a nuanced understanding of how the mattress interacts with the user, providing valuable insights for optimizing comfort, support, and overall sleep quality.

This novel metric system sets a new standard in mattress evaluation, offering a sophisticated approach to quantify and analyze mattress performance precisely and practically.

Figure 3:
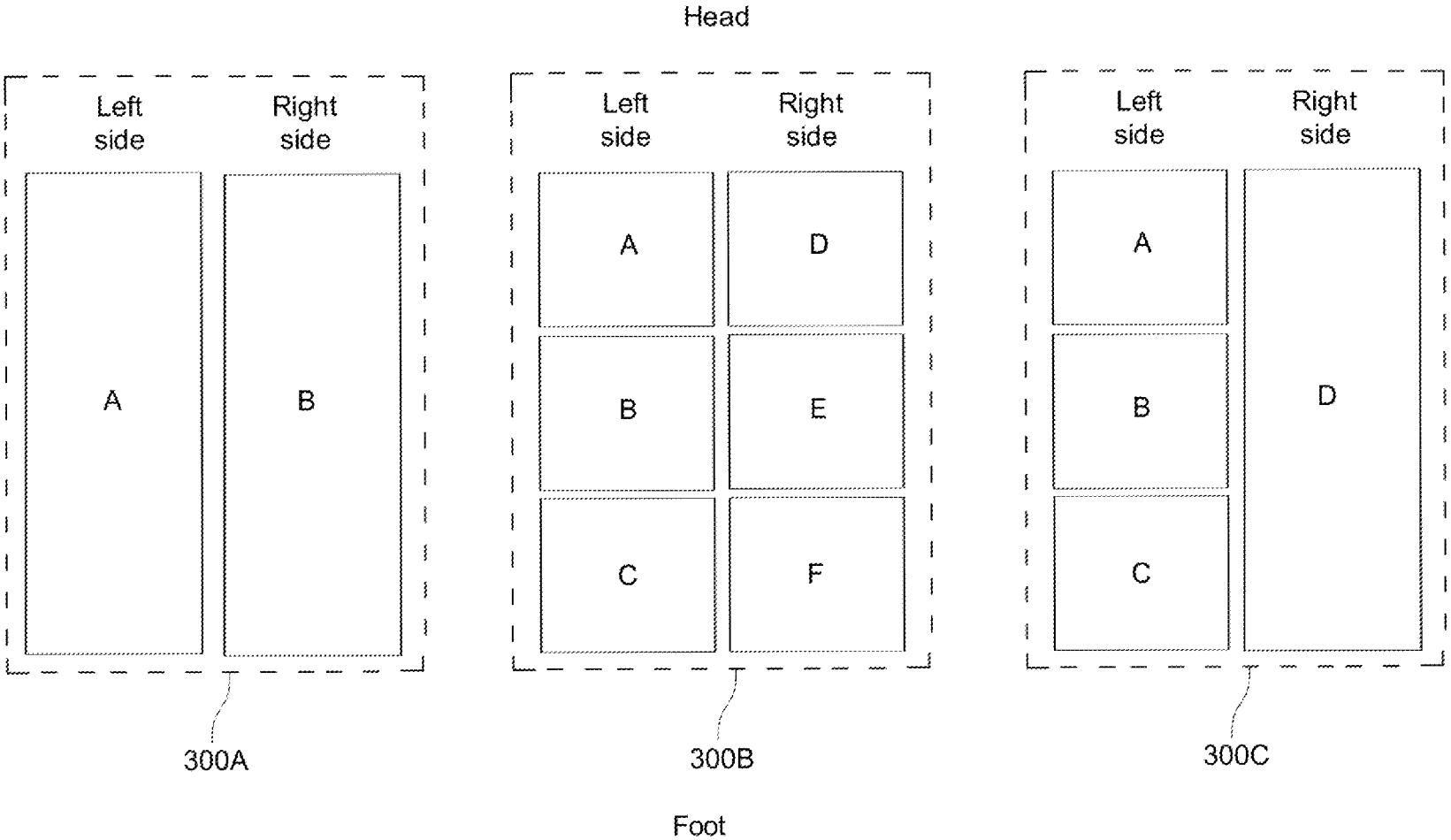
FIG. 3 shows example modular configurations, according to embodiments of the disclosure.

FIG. 3 shows example modular configurations 300A, 300B, and 300C, according to embodiments of the disclosure. Each configuration provides non-limiting examples of how a layer (e.g., top layer with dual-zip technology, middle layer, and/or bottom layer) can be configured in embodiments of the disclosure. In each configuration 300A, 300B, and 300C, there is a left and right side of the bed and a head and foot of the bed.

Each individual module specified in these non-limiting examples (no matter the layer or configuration) can have a different VCM, and each module can be a different material type (ex: pocket coil, memory foam, or the like). In particular configurations, combining different modules utilizes a set of standard module sizes (regarding size/dimension) that can be personalized to a person based on their specific needs or wants. In particular configurations involving six modules for a layer, the width of a module can roughly be a standard mattress width divided by two, and the length can be a standard mattress length (measured from head to foot) divided by three. Where a standard mattress is smaller (e.g., Twin and Twin XL), the width measurement may be the same as the smaller-sized mattress. Such sizing may vary according to a number of factors including, but not limited to, material composition, how it responds to external force/pressure, elasticity in materials, etc. Thus, although modules may be considered to have the same-sizes, variances on the order of +/− five percent (or more) may exist for same-size modules. With regards to height, the size may be anywhere from a one-quarter inch up to sixteen inches. While such dimensions have been provided, other dimensions may be utilized in other configurations-including configurations where modules are not the same sized.

Configuration 300A has a component A on the left side and a component B on the right side. Configuration 300B has six modular components: A, B, C, D, E, and F. Components A, B, and C correspond to the left side, whereas components D, E, and F correspond to the right side. Components A and D correspond to shoulder components. Components B and E correspond to hip components. Components C and F correspond to foot components. While six modular parts are shown in this configuration, other configurations may have different numbers, namely more than six or less than six. As a non-limiting example, some mattress sizes and/or configurations, such as a Twin Extra Long (sometimes referred to as a TXL), can have three modules within a layer. And, while the components in configuration 300B modular parts are generally shown as having three per side of the bed, other configurations may have different numbers on each side. As a non-limiting example, one side may have four modules, and the other may have three. In yet another non-limiting example, modules B and E in FIG. 300B can be larger (measured from a length head to foot) than module A, C, D, and F.

Configuration 300C has three modular components, A, B, and C, on the left side and a single component, D, on the right side. Component A corresponds to a shoulder component. Component B corresponds to a hip component. Component C corresponds to a foot component. In certain configurations, the inverse of configuration 300C may be utilized where there are three modular components on the right side and a single modular component on the left side.

Operationally, a combination of configurations can be used for different layers within the same mattress. For example, configurations 300A and 300B can be in the same mattress system. As another example, configurations 300A, 300B, and 300C may exist in the same system. As yet another example, configurations 300A and 300C may exist in the same system. As yet a further configuration, the same configuration can be used in each layer within the same mattress, the layers don't have to be different configurations.

Figure 10:
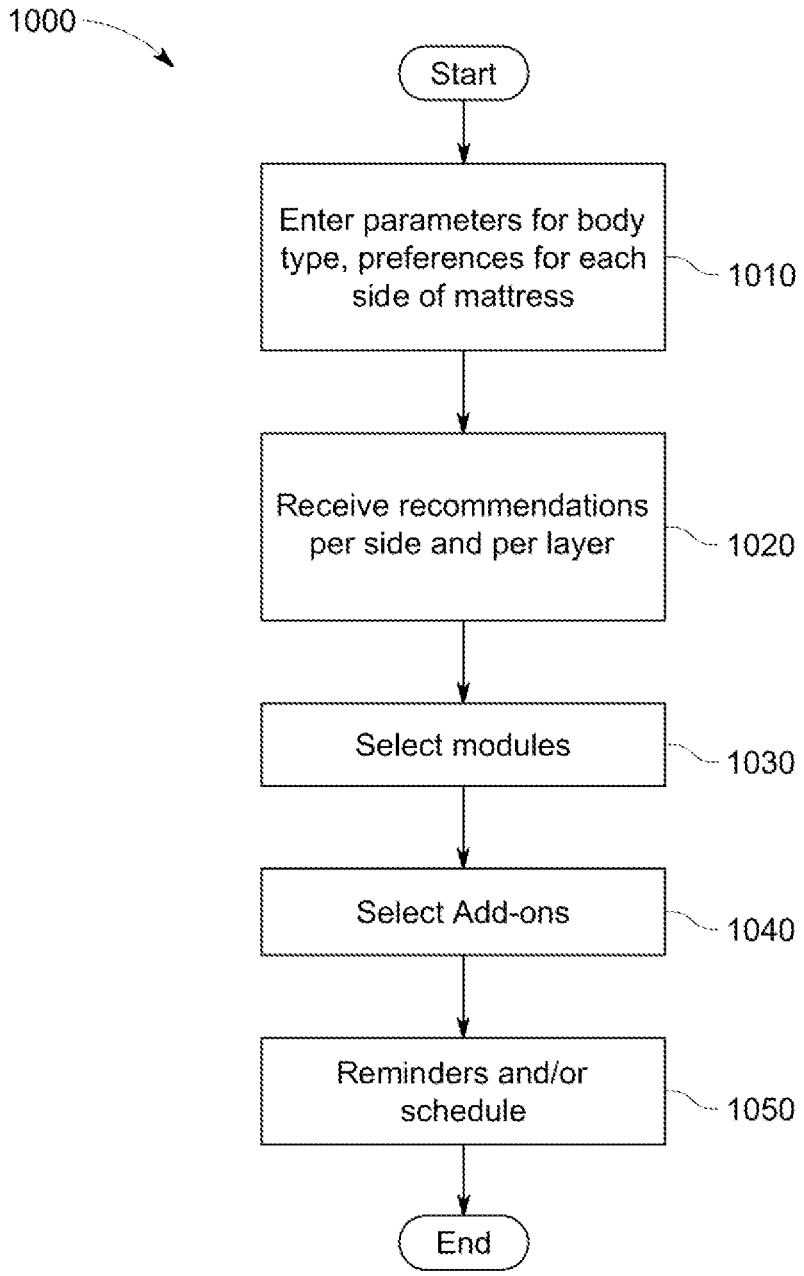
FIG. 10 shows a general process for a consumer receiving a modular system, according to an embodiment of the disclosure.

Additionally, each module in FIG. 3 can be the same or different from the other modules in the same mattress system. A different Variable Compression Measure (VCM) may exist for each of the modules. Additionally, modules with different material types and compositions may exist within the same layer and/or side of the bed. As an example, a consumer can follow a selection process, as seen in FIG. 10. In this scenario, if the consumer is choosing configuration 300B for the contour layer, all modules within that specific layer can be a different VCM and material composition. Alternatively, in the same configuration, the consumer could choose modules A, B, and C to be the same VCM and material composition while modules D, E, and F are a different VCM and material composition. This is all determined by the selection process and is based on the consumer's individual needs, wants, and sleeping preferences. The customization and personalization possibilities within the design of the modular mattress system allows for sleep partners to no longer have to compromise on their individual comfort.

While a Variable Compression Measure (VCM) with its corresponding three parameters of Millimeters of Mercury (mmHg), Contact Surface Area (CSA), and Weight Displacement using Indentation Load Deflection (ILD) may be utilized in some configurations, other configurations may only prescribe one or two of the parameters of the Variable Compression Measure (VCM) for a particular module. Additionally, in yet different configurations, other manners of classifying differences in the modules may be utilized. For example, the parameters used during the selection process could be determined by the method and/or place the consumer is purchasing the mattress (online, retail, etc.).

For a particular side of the bed, by breaking the load into distinct sections and zones (e.g., shoulder, hip, and foot—where three are used), different VCMs can be considered for each component and the load it is designed to support. For example, the human body has approximately sixty-five (65) percent of its weight between the top of the rib cage and the kneecap. Accordingly, the VCM design of the hip modular parts (e.g., components B and E in configurations 300B and B in configuration 300C), which would bear such weight, could be quite different than modular parts for the foot (e.g., components C and F in configurations 300B and C in configuration 300C) and modular parts for the shoulder (e.g., components A and D in configurations 300B and component A in configuration 300C). Moreover, the VCM design for modular parts would be different if designed to support a 100-pound person than the VCM design for the same would be if designed to support a 250-pound person. This could be represented in the form of a document that the consumer receives after completing the selection process. For a consumer assembling their mattress in their home, they could reference a provided material (called a "sleep profile") to determine where each module is to be placed within the bucket. In particular configurations, each sleeper can have their own sleep profile. And such a sleep profile can be accessible with an app associated with the mattress system. Further details of the app are described below.

With reference to configuration 300B, even if components B and E had the same material composition, the VCM could be different with users of different weights. Alternatively, if components B and E had different material compositions, the VCM ratings could be the same.

Another VCM design feature of the modular parts considers user preference. More specifically, a user provides input into what they seek regarding support and/or comfort.

Yet another VCM design feature, according to certain configurations, considers the continued response of a module or component over time. A module can be rotated in a particular configuration, for example, 90 degrees, 180 degrees, or 270 degrees from its previous orientation during use. An example of rotating is described below with reference to FIG. 12A. As a non-limiting example, in FIG. 3 configuration 300B, module E can switch places with module B since the modules are all the same size in this configuration. As another non-limiting example, module F in configuration 300B can change places with module A. If these modules had a different VCM and material composition, there could be a noticeable difference in feel when lying on the mattress. Additionally, a module can be flipped in certain configurations where a prior top side is now facing down. An example of different flipping manners is described in FIG. 12B. Moreover, in certain configurations, used modules may be interchanged or exchanged for new modules. An example of interchange is described with reference to FIG. 12C. Instead of having to replace an entire mattress when one of the sections starts to fatigue, one can simply exchange/replace that specific module for a new module (including in different positions) and flipped and/or rotated. Another example demonstrating the benefits of the modular design is being able to adjust the comfort of your mattress as your body grows and/or changes. As you grow and your body changes, your preferences may change. Today, the customer may want a firmer module but as their body changes, they may want to change a certain module with a softer VCM rating. This is not only observed when someone ages but can also be seen in other groups of people. For example, if an athlete experiences an injury, they may need to swap one of their current modules for another module that has different properties and/or characteristics. Another non-limiting example of a group of people that may benefit from the interchangeability aspect of the modular design is pregnant women. As they progress through the different stages of pregnancy, their body can change, and they may need to adjust the comfort of their side of the mattress to achieve a more comfortable sleep. In each configuration (e.g., rotated, flipped, and interchanged or exchanged), such may occur according to a particular frequency or schedule. As described in further detail below with reference to FIG. 10, a program that reminds the sleeper/user to rotate their module(s) may be used to communicate and remind the consumers to either rotate module(s) or have module(s) replaced. Consumer communications can be varied according to set frequency or schedule. Such a set frequency or schedule can be specifically tailored for a consumer based on the preferences and/or profile of the consumer. Alternatively, in some configurations, feedback on the actual user of the module (e.g., from a sensor connected to the module) may be used to determine how and when to communicate with a consumer. Additionally, in yet further configurations, a module that is returned can be assessed and measured to determine wear over time for the particular module/user combination to make a recommendation on the adjustment that may be necessary. An example adjustment may be that a particular user of a particular module wears down the module at a quicker pace than the average similarly situated user; accordingly, the module may need to be adjusted or replaced more frequently.

To facilitate a replacement and/or adjustment process, flags, tags, labels, colors, and/or any other appropriate indicator may be used on a module to label any particular portion for an understanding of its orientation. As a simple, non-limiting example, an arrow can be labeled for later reference as to whether, for a particular module, the arrow is on the top side or bottom side. The arrow can also indicate whether it is being faced towards the top or bottom of the bed and towards the inside or outside of the bed. Additionally, the location of the module with the area can also be specified. Also, arrows may have different colors or shapes. Yet other tag techniques may also be used.

In one particular configuration, a smart tag may automatically provide the orientation. Any suitable technology to measure the orientation of a module with reference to the bed. One example includes a switch on the side of the bed that sends different signals depending on whether it's up or down (e.g., similar to a reed switch, gravity makes the connection). Yet other automated techniques include simply taking a picture of the modules for a level with the symbols for each module providing information to a system as to orientation.

Individual modules can be replaced on different or similar schedules in additional configurations. In scenarios where one module wears more over time (e.g., in some designs, hip module), such a module might be replaced more frequently than others. And, again, different users of the same module may have different frequencies for replacement.

When a new material or configuration for a modular part is released or developed, a consumer does not need to purchase an entirely new mattress system, they can merely just replace one of their current modules for the new module.

According to particular embodiments, based on the module's design, a user can subscribe for exchanged modules being obtained on a schedule. For example, a user may purchase a module from a store (e.g., after receiving a reminder) or have it shipped automatically or on demand.

Figure 4:
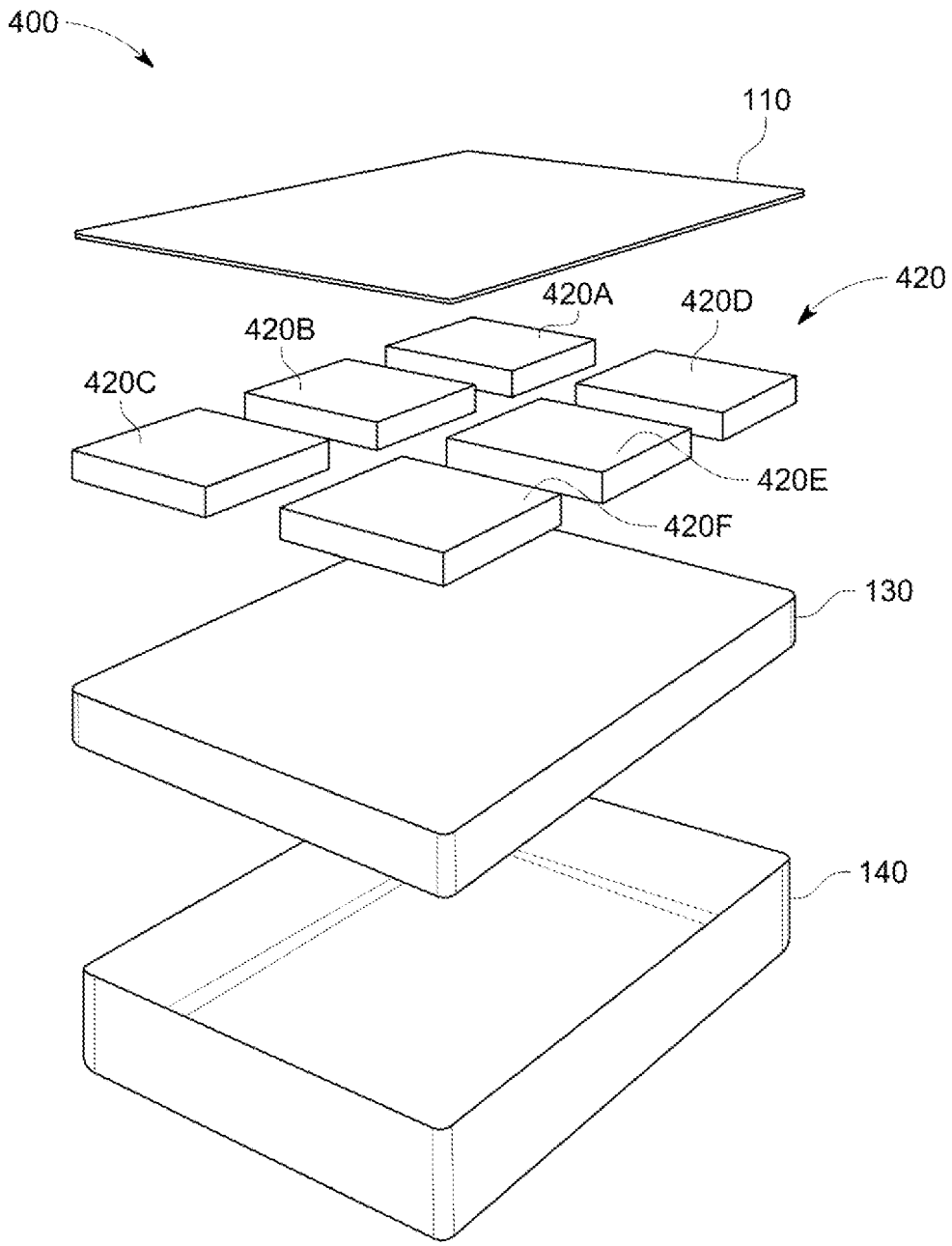
FIG. 4 shows a system having a modularized contour layer, according to an embodiment of the disclosure.

FIG. 4 shows a system 400 having a modularized contour layer, according to an embodiment of the disclosure. The mattress system 400 of FIG. 4 is a non-limiting example of the use of configurations in FIG. 3. Accordingly, the discussion supplied for FIG. 3 applies to FIG. 4. The mattress system 400 is similar to the mattress system 100 of FIG. 1, with the top layer 110, the bottom layer 130, and the box 140. The mattress system 400 here differs in that the middle layer 420 (often called the contour layer) includes six modular parts 420A-420F arranged like configuration 300B of FIG. 3. In particular, modular parts 420A, 420B, and 420C correspond to components A, B, and C on the left side of the configuration 300B of FIG. 3. Likewise, modular parts 420D, 420E, and 420F correspond to components D, E, and F on the right side of the configuration 300B of FIG. 3. Each of these modules (no matter the layer) can be different VCMs and/or material compositions.

Figure 5:
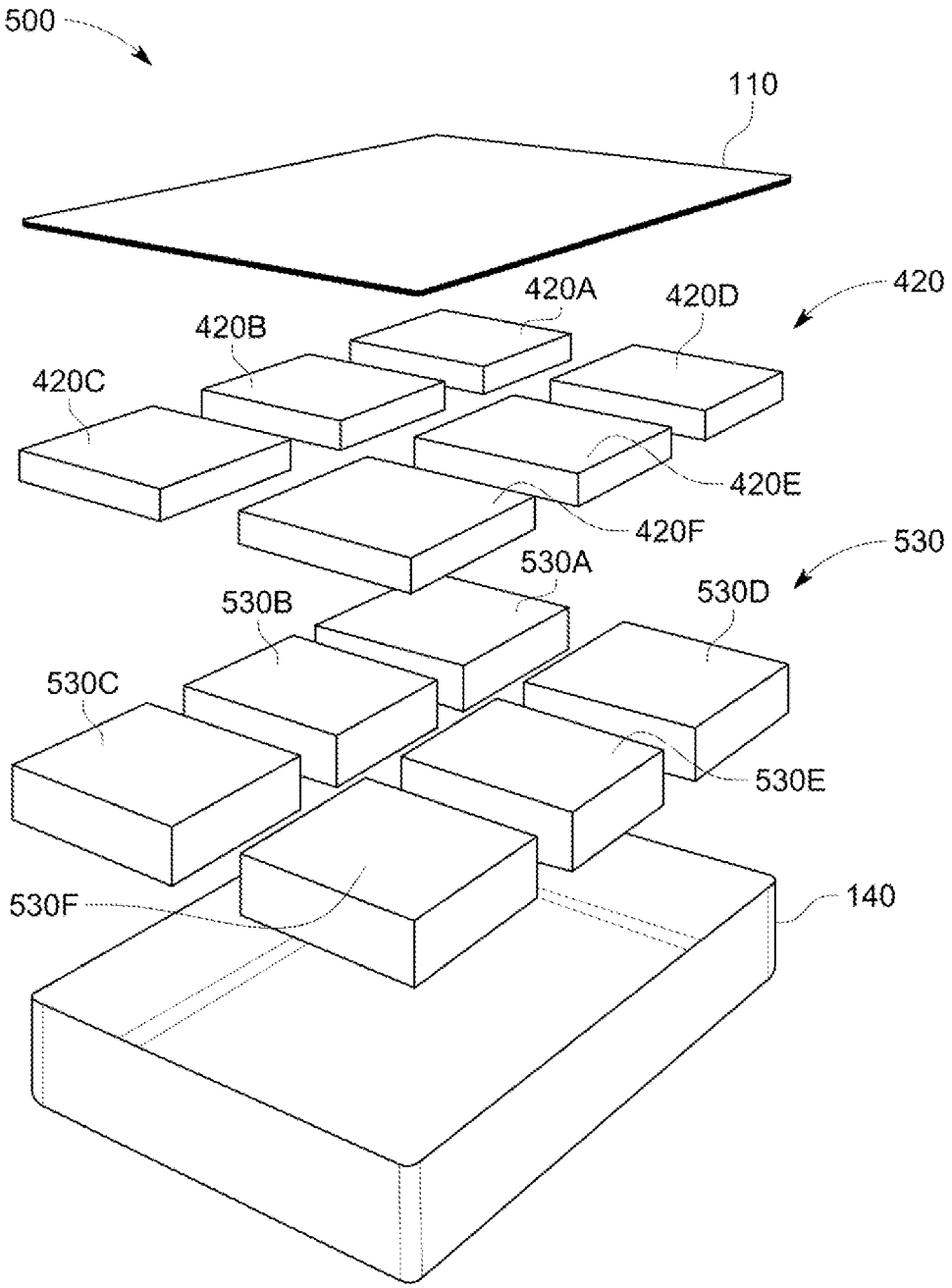
FIG. 5 shows a system having a modularized contour layer and a modularized support layer, according to an embodiment of the disclosure.

FIG. 5 shows a system 500 having both a modularized contour layer and a modularized support layer, according to an embodiment of the disclosure. The mattress system 500 of FIG. 5 is another non-limiting example of the use of configurations in FIG. 3. Accordingly, the discussion supplied for FIG. 3 applies to FIG. 5. The mattress system 500 is similar to the mattress system 400 of FIG. 4 with the top layer 110, the bottom layer 130, the modularized middle layer 420, and the bucket 140. The mattress system 500 here differs in that the bottom layer 530 includes six modular parts 530A-530F like configuration 300B of FIG. 3. While six modular parts are shown in this configuration, other configurations may have different numbers, namely more than six or less than six.

Although not shown in FIG. 3, 4, or 5, flexible barrier walls made of any suitable material may be placed in between the bucket and modules (like a racetrack around the interior border of the eurobox). In some designs, such a wall may only partially extend from an earlier layer.

Figure 6:
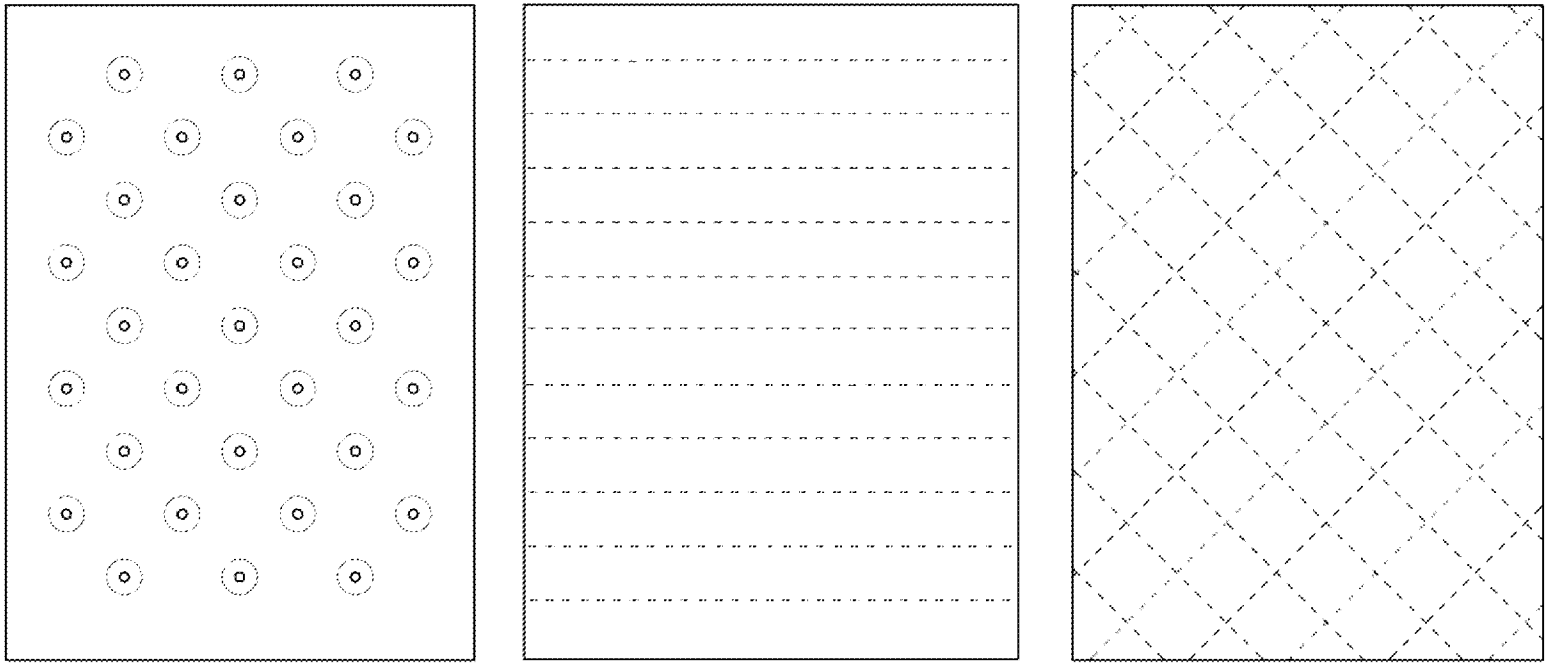
FIG. 6 shows three examples of quilted comfort layers, according to an embodiment of the disclosure.

FIG. 6 shows three examples of quilted comfort layers, according to an embodiment of the disclosure. The one on the left is soft, the one in the middle is medium, and the one on the right is firm.

Figure 7:
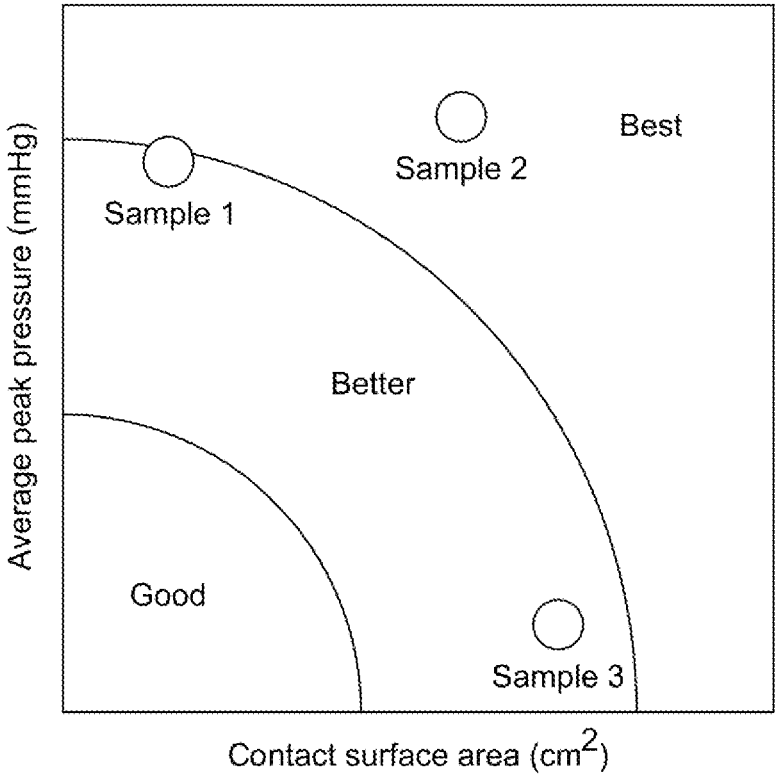
FIG. 7 shows on a graph a general relationship between Contact Surface Area and Average Peak Pressure.

FIG. 7 shows on a graph a general relationship between contact surface area and average peak pressure. In the graph of FIG. 7, a line generally represents mattress designs that may be considered good, better, and best. Three samples are plotted: Sample 1, Sample 2, and Sample 3.

Figure 8:
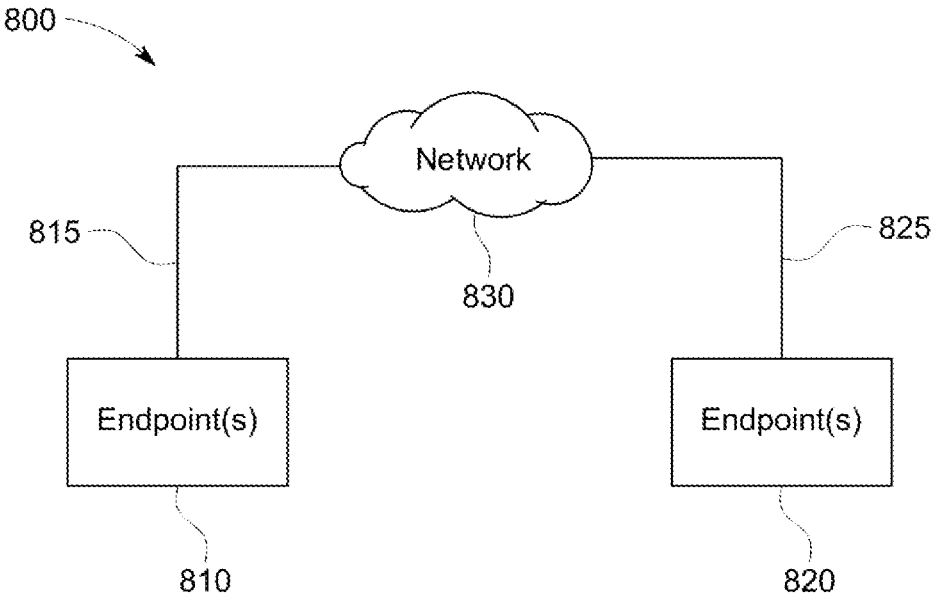
FIG. 8 is a simplified block diagram illustrative of a communication system.

FIG. 8 is a simplified block diagram illustrative of a communication system 800 that can be utilized to facilitate communication between endpoint(s) 810 and endpoint(s) 820 through a communication network 830, according to particular embodiments of the disclosure. When referencing communication, for example, showing arrows or "clouds," or "networks," any of such communication may occur in the manner described below or in other manners. Likewise, the endpoints may generally correspond to any two particular components described (or a combination of components) with another component or combination of components.

As used herein, "endpoint" may generally refer to any object, device, software, or any combination of the preceding that is generally operable to communicate with and/or send information to another endpoint. In certain configurations, the endpoint(s) may represent a user, which in turn may refer to a user profile representing a person. The user profile may comprise, for example, a string of characters, a username, a passcode, other user information, or any combination of the preceding. Additionally, the endpoint(s) may represent a device that comprises any hardware, software, firmware, or combination thereof operable to communicate through the communication network 830.

Examples of an endpoint(s) include, but are not necessarily limited to, a computer or computers (including servers, applications servers, enterprise servers, desktop computers, laptops, netbooks, tablet computers (e.g., IPAD), a switch, mobile phones (e.g., including IPHONE and Android-based phones), networked televisions, networked watches, networked glasses, networked disc players, components in a cloud-computing network, a remote or any other device or component of such device suitable for communicating information to and from the communication network 830). Endpoints may support Internet Protocol (IP) or other suitable communication protocols. In particular configurations, endpoints may additionally include a medium access control (MAC) and a physical layer (PHY) interface that conforms to IEEE 801.11. If the endpoint is a device, the device may have a device identifier such as the MAC address and may have a device profile that describes the device. In certain configurations, where the endpoint represents a device, such device may have a variety of applications or "apps" that can selectively communicate with certain other endpoints upon being activated. In particular configurations, an "app" on a mobile phone may be used to communicate with consumers, for example, in the Rotation Reminder referenced in FIG. 10.

The communication network 830 and links 815, 825 to the communication network 830 may include, but is not limited to, a public or private data network; a local area network (LAN); a metropolitan area network (MAN); a wide area network (WAN); a wireline or wireless network (WIFI, GSM, CDMA, LTE, WIMAX, BLUETOOTH or the like); a local, regional, or global communication network; portions of a cloud-computing network; a communication bus for components in a system; an optical network; a satellite network; an enterprise intranet; other suitable communication links; or any combination of the preceding. Yet additional methods of communications will become apparent to one of ordinary skill in the art after having read this specification. In particular configurations, information communicated between one endpoint, and another may be communicated through a heterogeneous path using different types of communications. Additionally, certain information may travel from one endpoint to one or more intermediate endpoint before being relayed to a final endpoint. During such routing, select portions of the information may not be further routed. Additionally, an intermediate endpoint may add additional information.

Although endpoint generally appears as being in a single location, the endpoint(s) may be geographically dispersed, for example, in cloud computing scenarios. In such cloud computing scenarios, an endpoint may shift hardware during backup. As used in this document, "each" may refer to each member of a set or each member of a subset of a set.

When the endpoints(s) 810, 830 communicate with one another, any of a variety of security schemes scheme may be utilized. As an example, in particular embodiments, endpoint(s) 820 may represent a client, and endpoint(s) 830 may represent a server in a client-server architecture. The server and/or servers may host a website. And, the website may have a registration process whereby the user establishes a username and password to login to the website. Alternatively, the user may need to download an application to their smart phone, enabling them to create an account/profile so they can complete the registration process. The application could also serve as a means for the user to book an in-person demonstration of the mattress system at a brick-and-mortar location. This could be a part of the selection process seen in FIG. 10. The website may additionally utilize a web application for any particular application or feature that may need to be served up to website for use by the user.

A variety of embodiments disclosed herein may avail from the above-referenced communication system or other communication systems.

Figure 9:
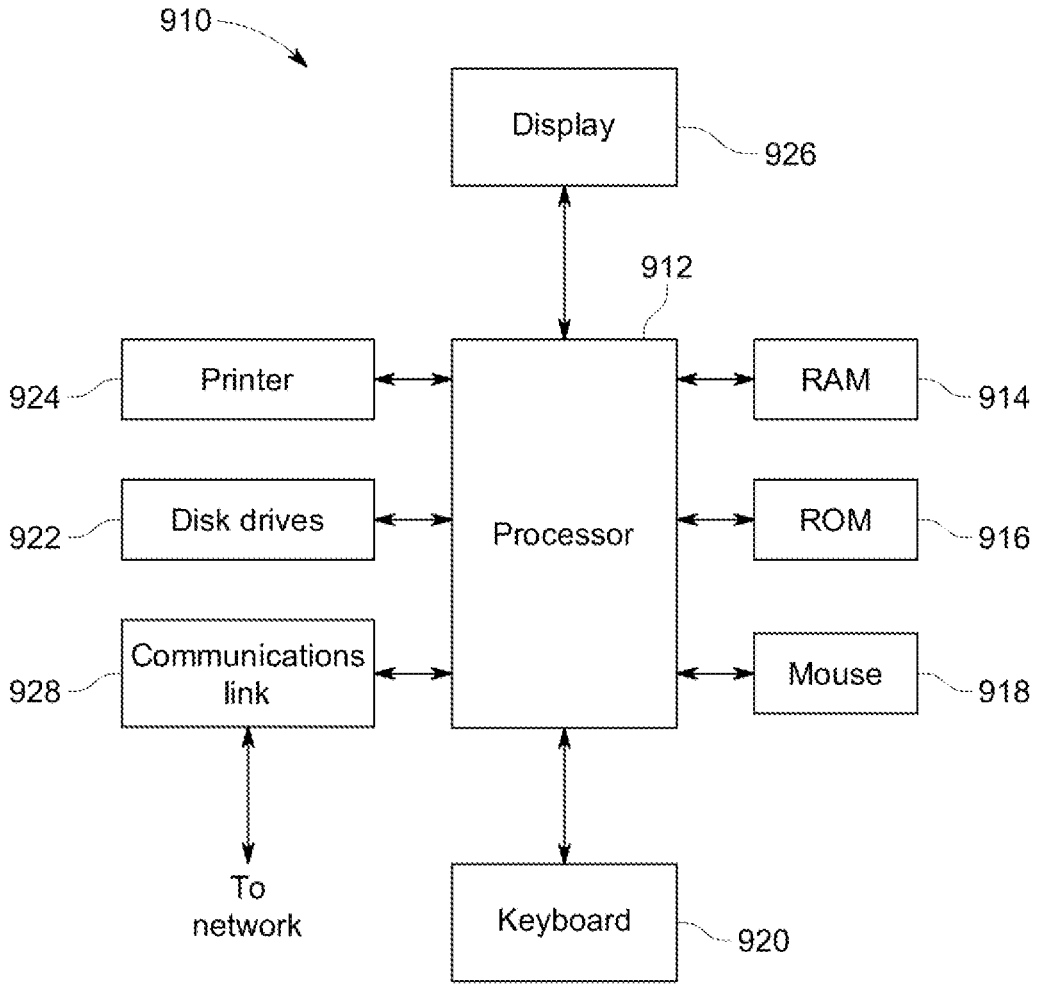
FIG. 9 is an embodiment of a general-purpose computer that may be used in connection with other embodiments of the disclosure.

FIG. 9 is an embodiment of a general-purpose computer 910 that may be used in connection with other embodiments of the disclosure to carry out any of the referenced functions described herein and/or serve as a computing device for endpoint(s) 810 and/or endpoint(s) 820. In executing the functions described above, the computer is able to do things it previously could not do. The general-purpose computer 910 may have some of the features described or use alternative features. As a non-limiting example, the general-purpose computer may be a mobile phone or tablet running iOS or Android operating system and have no need for a mouse 918. And the keyboard 920 may be integrated with the display 926 as a "touch" screen.

General purpose computer 910 may generally be adapted to execute any of the known OS2, UNIX, Mac-OS, Linux, Android iOS, and/or Windows Operating Systems or other operating systems. The general-purpose computer 910 in this embodiment includes a processor 912, random access memory (RAM) 914, a read only memory (ROM) 916, a mouse 918, a keyboard 920 and input/output devices such as a printer 924, disk drives 922, a display v26 and a communications link 928. In other embodiments, the general-purpose computer 910 may include more, less, or other component parts. Embodiments of the present disclosure may include programs that may be stored in the RAM 914, the ROM 916 or the disk drives 922 and may be executed by the processor 912 in order to carry out functions described herein. The communications link 928 may be connected to a computer network or a variety of other communicative platforms including, but not limited to, a public or private data network; a local area network (LAN); a metropolitan area network (MAN); a wide area network (WAN); a wireline or wireless network; a local, regional, or global communication network; an optical network; a satellite network; an enterprise intranet; other suitable communication links; or any combination of the preceding. Disk drives 922 may include a variety of types of storage media such as, for example, floppy disk drives, hard disk drives, CD ROM drives, DVD ROM drives, magnetic tape drives or other suitable storage media. Although this embodiment employs a plurality of disk drives 922, a single disk drive 922 may be used without departing from the scope of the disclosure.

Although FIG. 9 provides one embodiment of a computer that may be utilized with other embodiments of the disclosure, such other embodiments may additionally utilize computers other than general-purpose computers as well as general-purpose computers without conventional operating systems. Additionally, embodiments of the disclosure may also employ multiple general-purpose computers v10 or other computers networked together in a computer network. The computers 910 may be servers or other types of computing devices. Most commonly, multiple general-purpose computers 910 or other computers may be networked through the Internet and/or in a client-server network. Embodiments of the disclosure may also be used with a combination of separate computer networks each linked together by a private or a public network.

Several embodiments of the disclosure may include logic contained within a medium. In the embodiment of FIG. 9, the logic includes computer software executable on the general-purpose computer 910. The medium may include the RAM 914, the ROM 916, the disk drives 922, or other mediums. In other embodiments, the logic may be contained within hardware configuration or a combination of software and hardware configurations.

The logic may also be embedded within any other suitable medium without departing from the scope of the disclosure.

While configurations described herein have been described as having three layers, more than (or less than) three layers may be utilized in some embodiments. Also, in some configurations, one or more of the three layers identified herein may have sub-layers. Some or all of the sub-layers may be modularized across different levels.

The modular nature of the embodiments described herein allows the addition of features to the mattress, such as, but not limited to, heating or cooling modules using Peltier devices and the like, frequencies massaging modules, sound modules (e.g., sound frequencies in hertz), and monitoring modules. Any of the preceding may be added to any layer of the bed-top, middle, or bottom. For example, where configuration 300A and 300B are used in the same mattress system, component B of configuration 300A (which may be in the contour layer) can have a massage module added and components E and F of configuration 300B (which may be in the support layer) may have a heating module.

Any of the preceding may be connected to appropriate wired or wireless devices for control and/or receipt of information. And, in certain configurations, the preceding may be an Internet of Things (IoT) device assisting a user. As a non-limiting example, the monitoring module may measure the condition of the modularized components and communicate the need for a changeout when ideal conditions are not being met. As a non-limiting example, where a VCM design has been configured to allow a deflection over time and where a sensor measures such a deflection as slowly reaching a threshold and then crossing that threshold, a communication can be sent to recommend an upgrade and why. Other non-limiting examples could be the monitoring of heart rate, body temperature, or if the sleeper is snoring. In yet further examples, wearable technology can read and/or collect data from a user using any suitable sensor. Non-limiting examples include, but are not limited to watches, rings, and chest-bands. Yet other may be utilized. Based on the reading(s), the mattress could autonomously perform an action in response to that measure.

In addition to the above, because an otherwise monolithic mattress is now modularized parts, such parts are easier to handle than the monolithic mattress. For example, replacing the modules and/or rotating the modules is more manageable than handling the same for the whole mattress. Additionally, in certain configurations, the modules can be compressed or reduced in size by a certain percentage for shipping. The packaging for shipping can be personalized to the consumer/end user and as well, for the components found within the packaging. The personalized aspect of the packaging and where it can be found should not be limited to any specific area on the packaging, regardless of if it is found on the inside or outside of the packaging. Further details of possible configurations associated with this detail are described with reference to FIGS. 16A-16D.

FIG. 10 shows a general selection process 1000 for a consumer choosing and receiving a modular system, according to an embodiment of the disclosure. With reference back to FIG. 8, in particular configurations, a user may have a device that corresponds to endpoint 810 and is communicating with endpoint 820, which may correspond with a server providing interactive feedback, for example, using any suitable graphical user interface through either and application or web interface, or a kiosk. Such a connection may be a login or other authentication. In other configurations, no authentication may be used. Additionally, while the term "user" is provided here, the "user" in some configurations may be a sales associate interacting on behalf of a consumer seeking to purchase. In particular configurations, a user may register for an account that may be accessible either via a website or an app. For a mattress having two sides, one account may exist per side. Or, a single account may be used for both sides with a profile for each side.

At step 1010, either as part of the registration process or an update to a preference, a user may enter the parameters for body type and preferences for each side of a mattress. As a non-limiting example, a user may enter weight and height-along with any other information such as the preferences of the consumer for the module(s) configuration. As one example, some users may prefer a firmer material, while others may prefer a softer material. Additionally, in particular configurations, instead of the user having to select whether there a side sleeper, back sleeper or stomach, the system can give the option for the sleeper to select on a sliding scale how much they sleep in that position (e.g., 10% slept on back, 15% slept on side, 75% slept on stomach=100%). In yet other configurations where a user doesn't know how they sleep, any suitable sensor (worn, in a module, or outside the module) may be measuring how a user sleeps to recommend what might be appropriate. In such configurations, a user's sleep patterns may change over time.

At step 1020, the system may provide recommendations for the module(s) configuration per side and per layer. Such recommendations may be specifically tied to the user input and any other parameters (e.g., popular configuration). At step 1030, a user may select particular desired components.

At step 1040 (or in conjunction with step 1030), a user may select an add-on, including any of a variety of smart technology modules that can be added. The consumer may also add sleep accessories (such as pillows, sheet sets, a mattress protector, etc.) that have product qualities and characteristics they share with mattress modules and layers (e.g., a sheet set that has cooling properties may pair well with a comfort layer that has cooling yarns). Such technologies include, but are not limited to heating or cooling modules using Peltier devices and the like, massaging modules, sound modules, and monitoring modules. In particular configurations, a user may choose to not have any add-ons.

At step 1050, a rotation reminder program may be used for communicating with the consumer. Reminders and/or schedules may be set for a particular user based on the particular selections in step 1030 and step 1040. Here, as a non-limiting example, a user can select how to be reminded of changes (e.g., text, email, app push notification) and, also, decide to subscribe to a subscription for select modules being shipped over time, as appropriate.

As referenced above, a module can be rotated in a particular configuration, for example, 90 degrees, 180 degrees, or 270 degrees from its previous orientation during use. Additionally, a modular part can be flipped in certain configurations where a prior top side is now facing down. The adjustment to the individual modules can provide a more even distribution of wear or fatigue point dispersal-thereby extending the life span of that individual module. Moreover, in certain configurations, used modular parts may be interchanged or exchanged for one another (including in different positions) and flipped and/or rotated. In each configuration (e.g., rotated, flipped, and interchanged or exchanged), such may occur according to a particular frequency or schedule where a user is reminded. To facilitate such a process, flags, tags, labels, colors and/or any other appropriate indicator may be used on a module to label any particular portion for an understanding of its orientation.

Modular parts can be replaced on different or similar schedules in additional configurations. In scenarios where one module wears more over time (e.g., in some designs, hip modular part), such a module might be replaced more frequently than others. Also, when a new material or configuration for a modular part is released or developed, a consumer does not need to purchase an entire mattress system and can merely replace the particular new modular part.

As alluded to above, according to particular embodiments, based on the module's design, a user can subscribe for exchanged modules being shipped on a schedule. Alternatively, the consumer may have the option to visit a brick-and-mortar retail location to purchase and pick-up a module. Such scheduling can be accomplished through the system.

Figure 11:
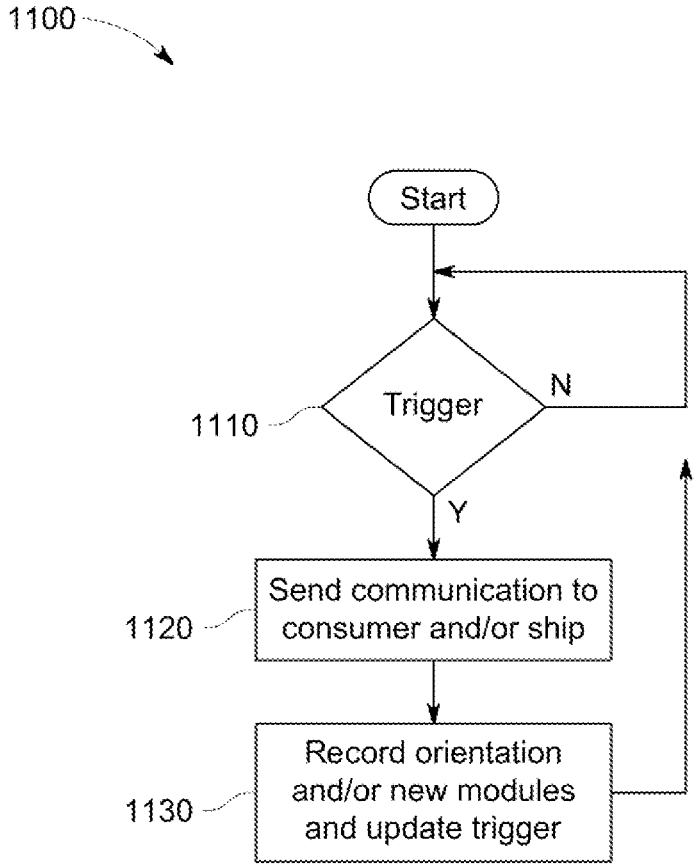
FIG. 11 shows a general process for initiating changes for a consumer in the system and recording those changes, according to an embodiment of the disclosure.

FIG. 11 shows a general process 1100 for initiating changes for a consumer in the system and recording those changes, according to an embodiment of the disclosure.

In step 1110, a trigger is initiated indicating a change needs to occur for a particular user. This may be triggered according to a schedule or feedback received from a smart connected device's sensor (e.g., a threshold has been exceeded).

In step 1120, either a communication is sent to the consumer to instruct change for the mattress system, or an exchange modular component is shipped on a schedule. Or a consumer can pick up a module at a brick-and-mortar retail location.

In step 1130, to understand that the change has occurred, a user can manually take steps to inform the system the change has occurred. In particular configurations, reference may be made to the indicator tags on the modules along with the location of the module. In particular configurations, a user interface may allow users to quickly indicate how the module is positioned. For example, where an application is used, a user can be presented with modules for a particular layer and confirm whether the tags look like the recommended change. The user can confirm in the application.

In other configurations, once all modules are positioned, a quick picture may be taken of all the tags on the modules where such tags are image-recognized for orientation. In such a configuration, image recognition specifies the orientation.

In yet other configurations, smart technologies may be used that automatically detect orientation using, for example, gravity or proximity to other tags and/or sensors.

Upon recording the change, the trigger is also updated.

The process then repeats with consideration of whether the trigger occurred taking into consideration the change.

In particular configurations, a new user experience is being provided to allow users to be more engaged with their mattress system to not only enhance comfort, but also change as the needs of the user change. As a non-limiting example, as a user may age from a child to adolescent, the same system may be used where weight and height changes are taken into consideration for module change. Additionally, in particular configurations, environmental factors can be taken into consideration for modules in the mattress system to accommodate cold or warm temperatures, humidity, and the like. Additionally, in addition to temporary conditions like pregnancy and injuries, other temporary considerations may be taken into consideration.

The new user experience also includes feedback from a user as to how a module is working (or not) and whether adjustments might need to be made. Where a sensor (e.g., smart watch or the like) is connected, the system can detect a sleepless night and inquire of the user the same for potential module adjustment.

As described below, the new user experience is also extended to the receipt of new modules, for example, in a box where custom labeling for a particular user can provide input for such a user.

Figure 12A:
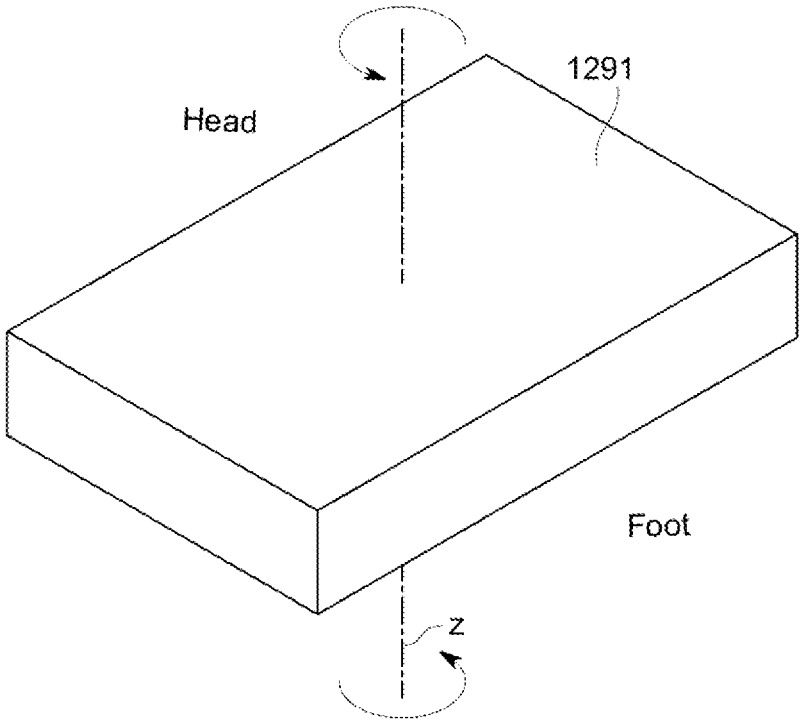
FIGS. 12A, 12B, and 12C show concepts of flipping, rotating, and swapping modules, according to an embodiment of the disclosure.
Figure 12B:
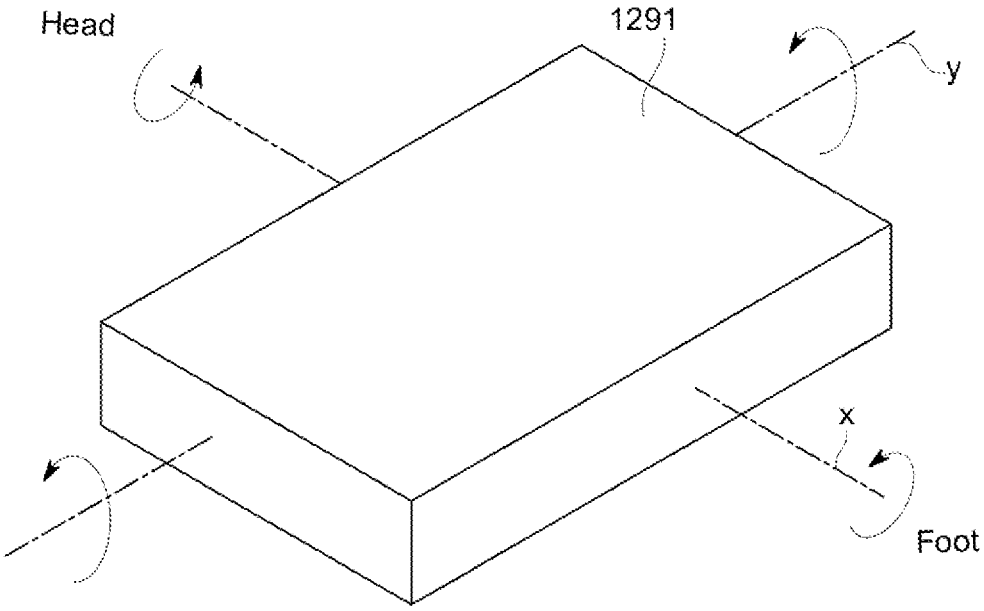
Figure 12C:
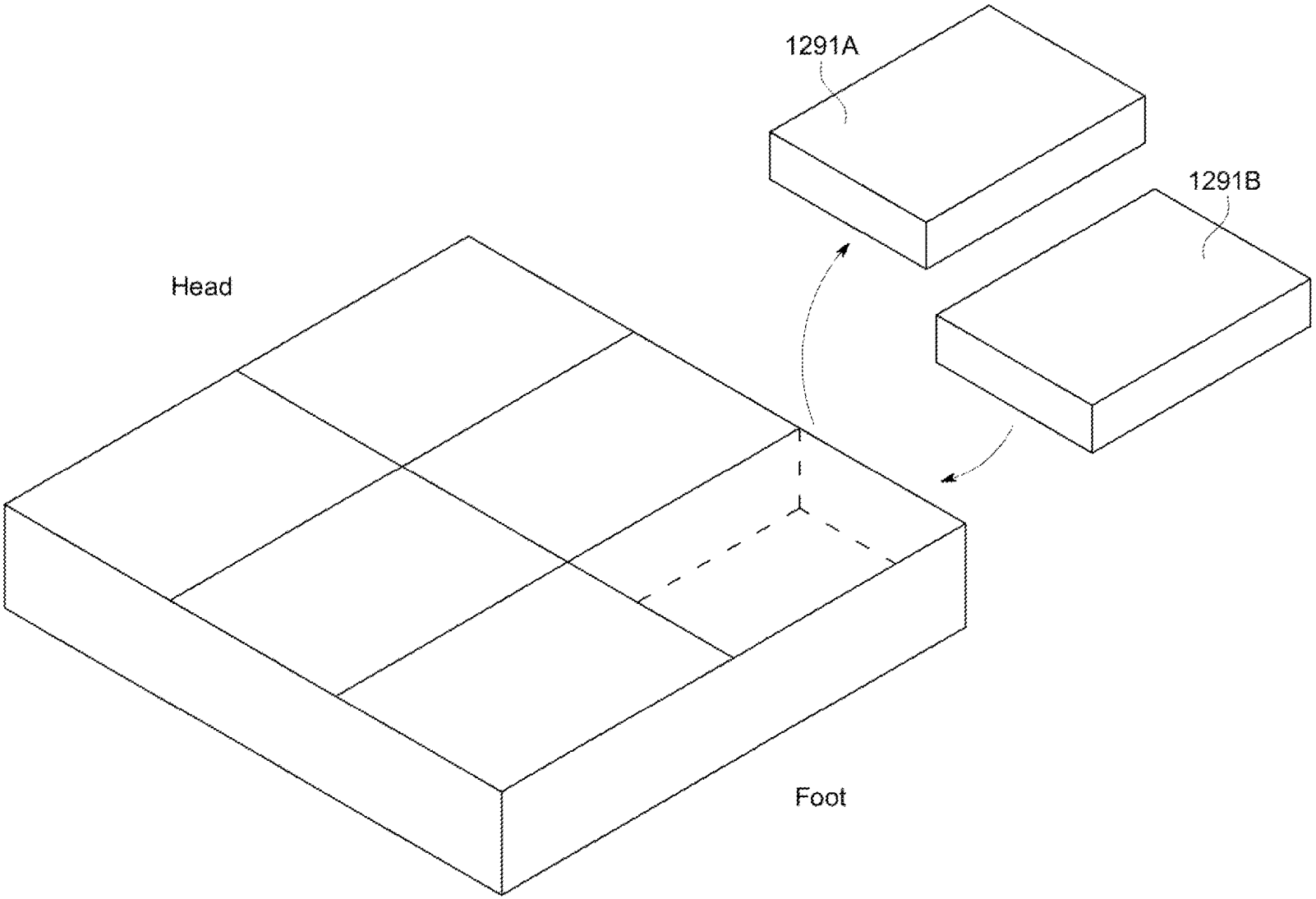

FIGS. 12A, 12B, and 12C show examples of rotating, flipping, and exchanging modules, according to embodiments of the disclosure.

In FIG. 12A, a module 1291 can be rotated, for example, around a z-axis. Non-limiting examples of rotations include 90 degrees, 180 degrees, and 270 degrees.

In FIG. 12B, module 1291 can also be flipped around an x-axis or a y-axis. Flipping around each respective axis exposes different portions of module 1291 to differing loads. As a non-limiting example, assuming the foot to head ran along the x-axis and the portion of the module seen is the top, a rotation of top to bottom along the x-axis does not change each respective end. Rather, each respective end remains closer to the head or foot. However, in the same scenario (e.g., foot to head ran along the y-axis), a rotation about the y-axis changes both the top to the bottom and, also, the portion of the module closer to the head or foot.

In FIG. 12C, a first module 1291A is pulled and replaced with regards to a second module 1291B. In particular scenarios, the first module 1291A may be an old module and the second module 1291B may be a new module of the same type as the first module 1291B. In other configurations, the second module 1291B may be a newer type of the first module 1291A. A variety of other types of scenarios can arise from swapping one module for another.

Figure 13A:
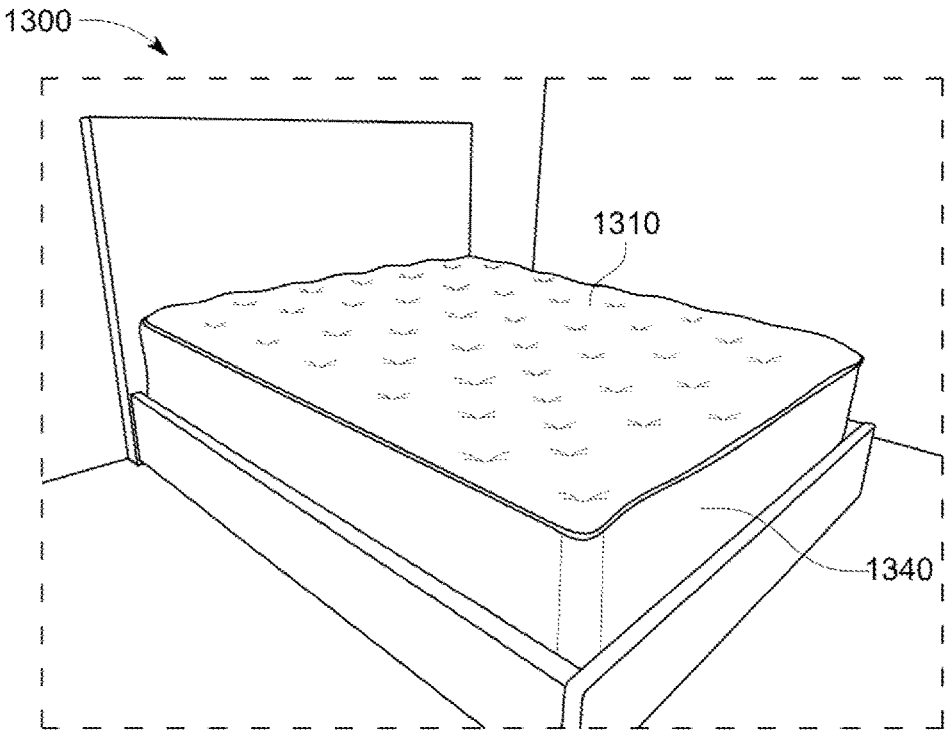
FIGS. 13A and 13B show a system having a modularized contour layer and a modularized support layer, according to an embodiment of the disclosure.
Figure 13B:
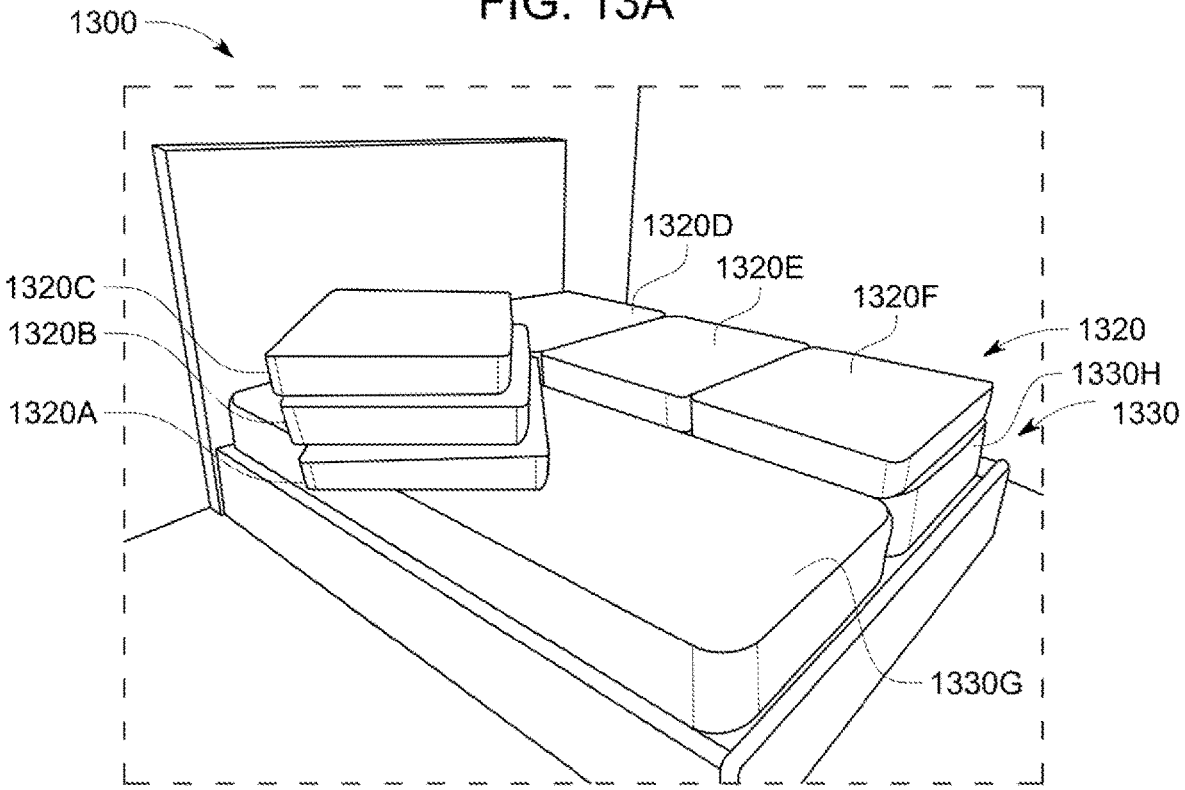

FIGS. 13A and 13B show a system having a modularized contour layer and a modularized support layer, according to an embodiment of the disclosure. The mattress system 1300 of FIGS. 13A and 13B is similar to the mattress system 500 of FIG. 5 with the top layer 1310, the modularized bottom layer 1330, the modularized middle layer 1320, and the bucket 1340 shown.

In FIG. 13A, the top layer 1310 of the mattress system 1300 has been placed on underlying modules; and, the eurobox 1340 has the modules enclosed within. The top layer 1310 is shown as a plush quilted comfort layer.

In FIG. 13B, the modularized middle layer 1320 is arranged as configuration 300B of FIG. 3 whereas the modularized bottom layer 1330 is arranged as configuration 300A of FIG. 3.

More particularly, modularized bottom layer 1330 is shown as having one module 1330G, 1330H per side. For the modularized middle layer 1320, modules 1320D, 1320E, and 1320F have been placed in their correct orientation; however, modules 1320A, 1320B, and 1320C have not yet been placed. Each of the modules in each of the layers may differ from the others. Each of these modules may (no matter the layer) have different VCMs and/or material compositions. Thus, as a non-limiting example, each of modules 1320A, 1320B, 1320C, 1320D, 1320E, and 1320F may have both a different VCM and material composition from all the other modules in modularized middle layer 1320. Similarly, each of the modules 1330G and 1330H may have both a different VCM and material composition. When any one of the modules needs to be changed or swapped out, they may do so.

Figure 14A:
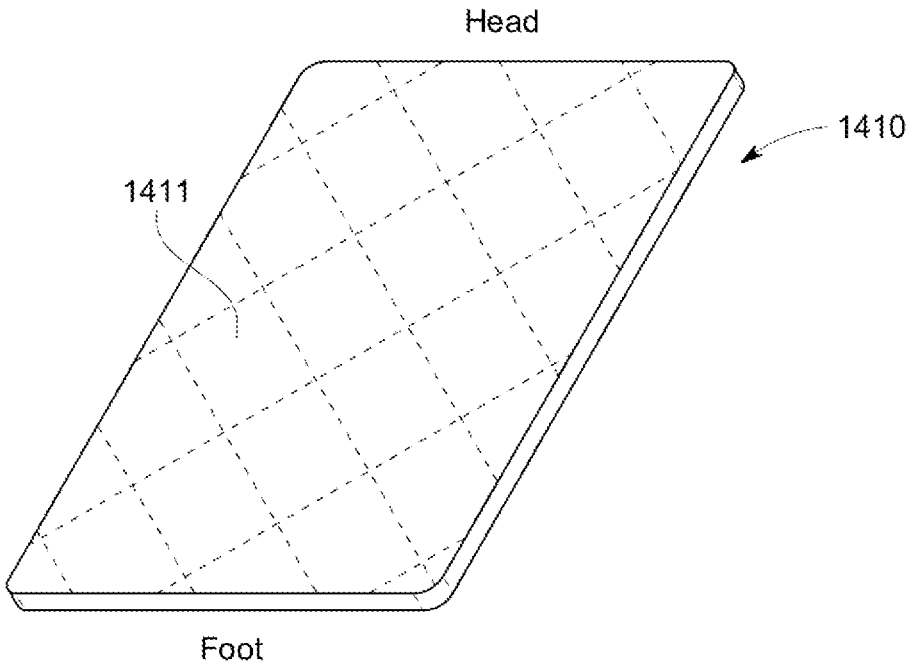
FIGS. 14A-14D illustrate features of the top layer including dual-zip technology, according to embodiments of the disclosure.
Figure 14B:
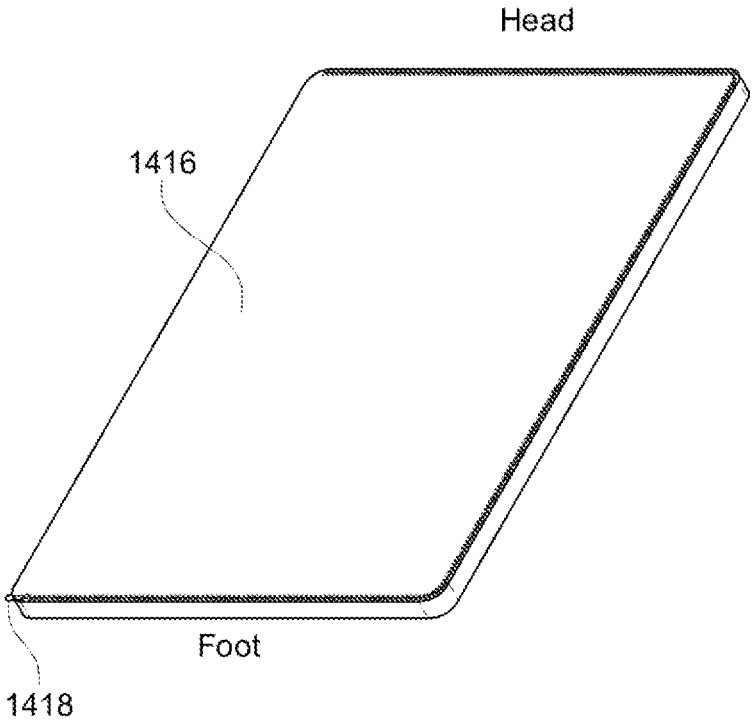
Figure 14C:
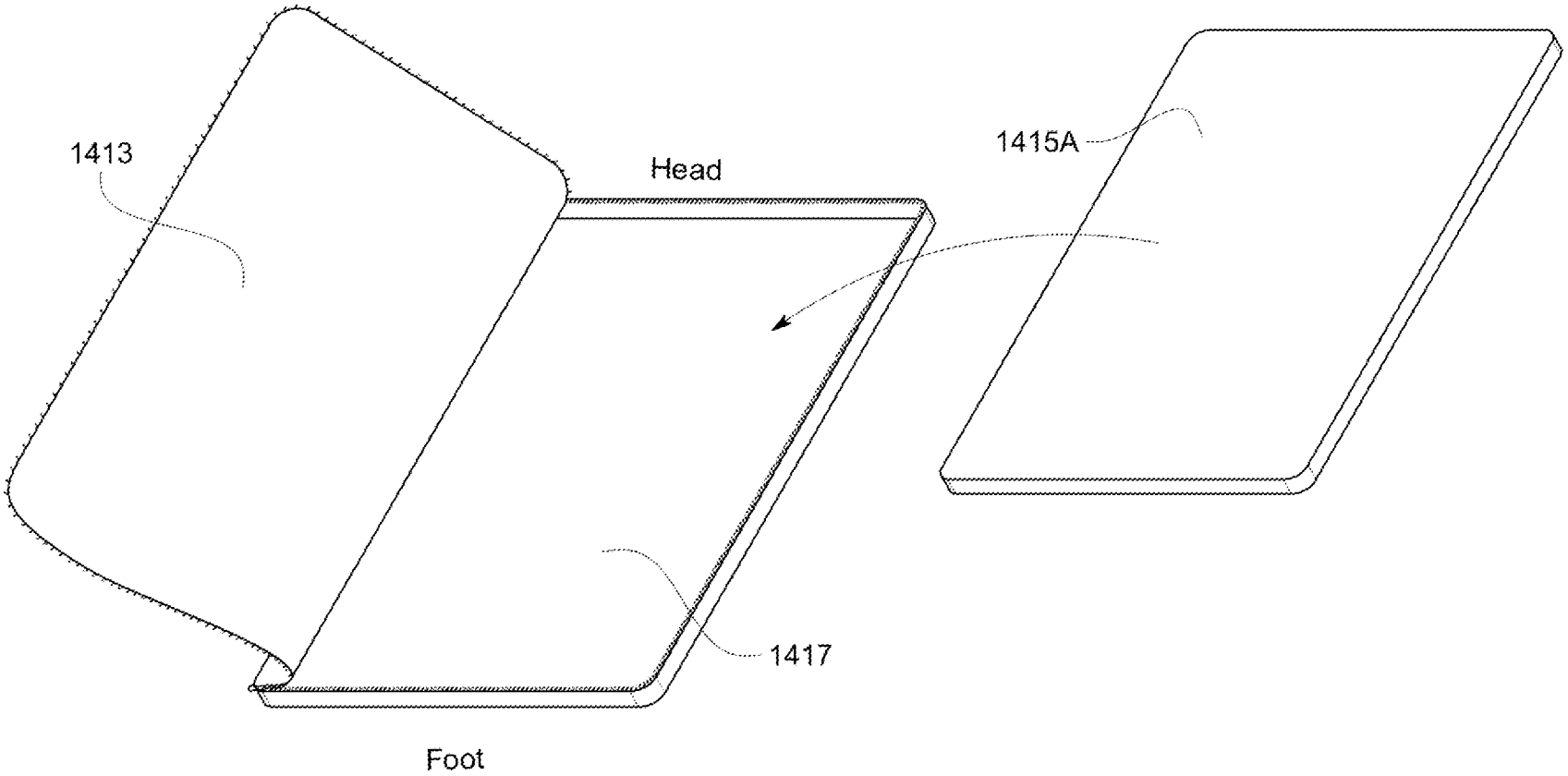
Figure 14D:
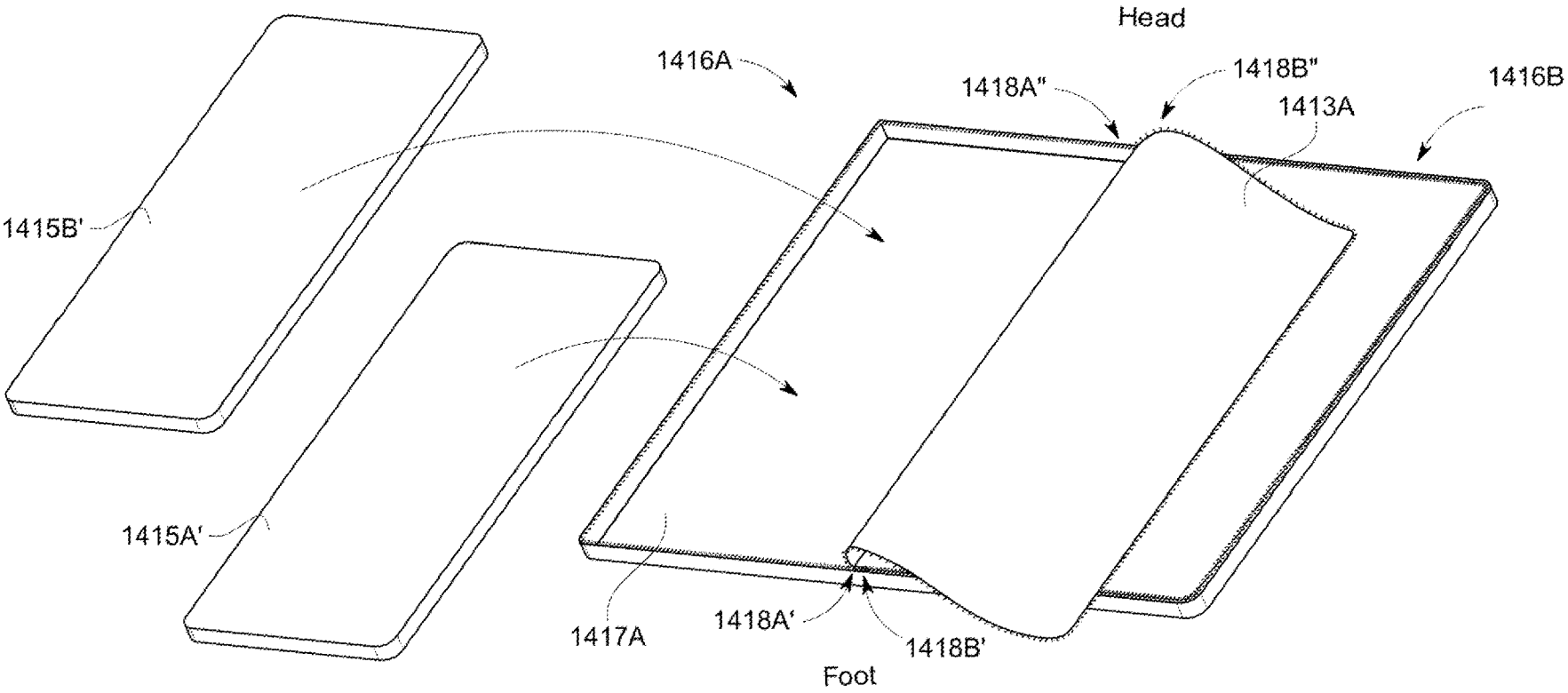

FIGS. 14A-14D show details of a dual-zip technology, according to an embodiment of the disclosure. A top layer 1410 may have a first fastener such as a zipper that allows the connects the top layer to the box (not seen in this figure). The top layer 1410 may also have a second fastener such as a zipper 1418 that allows access to a pocket 1416 that allows insertion of multiple layers of material such as but not limited to memory foam, pocket coils, polyurethane foam, organic latex, wool, kapok, down feather, and the like. Additionally, technology modules can be added in the dual-zip pouch(es). In particular configurations, the insertion of the material may be modularized per side and within a side. As seen in FIG. 3, any of the example configurations can be chosen regarding the pockets being zoned. For example, FIGS. 14B and 14C show a comfort layer with a single dual-zip pouch while FIG. 14D shows a comfort layer than has 2 pouches, one on each side. The dual-zip configuration seen in FIG. 14E can be seen in FIG. 3, 300A, which allows both sleepers to personalize their side of the mattress with the dual-zip technology pockets being zoned While a zipper is described as one fastener, in other configurations, other types of fasteners (other than a zipper) may be used to attach the top layer 1410 to the bucket. And, in yet different configurations, the top layer 1410 may not connect to the box and/or may not use fasteners.

Moreover, while a pocket with a zipper is described with reference to certain configurations, other configurations may have other enclosures (e.g., a sleeve, pouch, or the like) that hold the components in place. As an example, with reference to the configuration 300C of FIG. 3, one side of the bed could have three individual pockets while the other side only has one pocket that spans from the head to the foot of the bed.

Within the top layer of the mattress system, multiple layers of enclosures can exist. For example, the uppermost layer of the top layer can be a single enclosure that is a layer of wool, whereas another layer in the top layer can be an assortment of varying materials and firmness levels.

In FIG. 14A, the top layer 1410 is shown in isolation from the other portions. A fastener such as zipper may be unzipped to allow the top layer 1410 to be removed or partially removed. The top surface 1411 of the top layer 1410 is shown as having a quilted surface. In this example, the quilted surface is a firm comfort layer as seen in FIG. 6.

In FIG. 14B, the top layer 1410 has been flipped upside down to reveal pocket 1416 and zipper 1418.

In FIG. 14C, zipper 1418 has been unzipped to allow a flap 1413 to open to reveal an interior 1417 of the pocket 1416. One or more layers 1415A can be placed inside the interior 1417.

FIG. 14D shows how the top layer 1410 can have two pockets 1416A, 1416B-one per side. Pocket 1416A is open and pocket 1416B is closed. In open pocket 1416A, interior 1417A and flap 1413A are seen. Two layers 1415A' and 1415B' are shown as being placed in the interior 1417A of pocket 1416A. As a non-limiting example, 1415A' could be a module comprised of wool, and 1415B' could be a module comprised of latex. As well, both modules could have different VCM ratings. Though this figure only shows two modules being added, additional layers and/or modules can be added or removed from the dual-zip pouch. A different set of layers can be placed in pocket 1416B. The zipper for each pocket has a starting point 1418A', 1418B' and an ending point 1418A", 1418B".

Figure 15A:
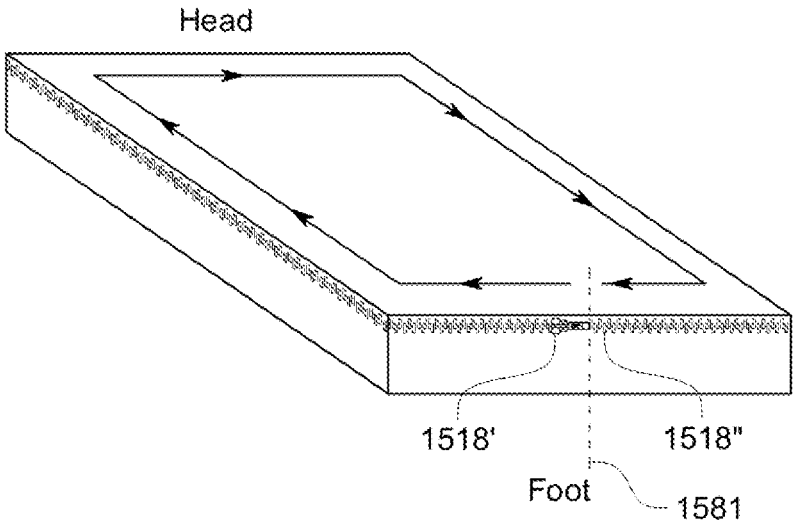
FIGS. 15A and 15B show zipper configurations, according to embodiments of the disclosures.
Figure 15B:
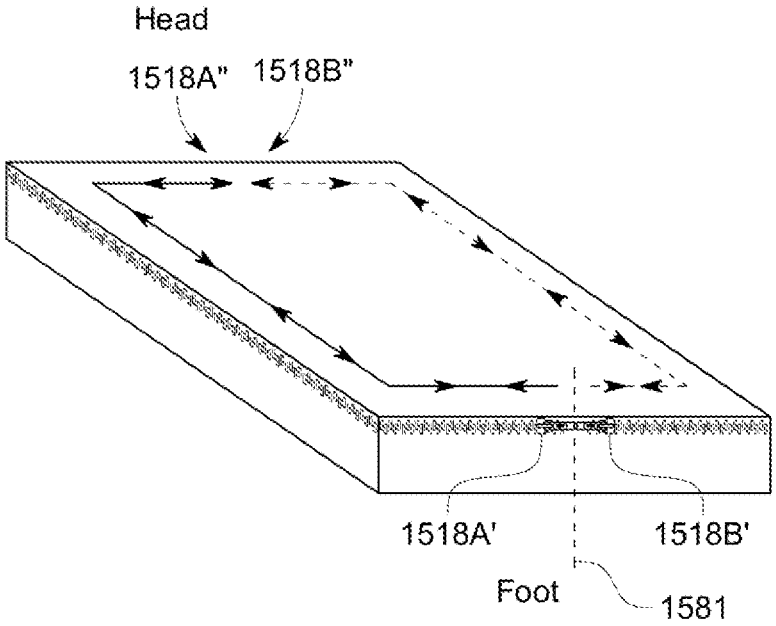

FIGS. 15A and 15B show zipper configurations, according to embodiments of the disclosures. In particular, these figures show example configurations for connecting the top layer to the eurobox. In FIG. 15A, the zipper track has a starting point 1518' and an ending point 1518" next to one another. A center of the mattress is represented by line 1581. In the configuration of FIG. 15A, an unzipping follows the lines of the arrows from the starting point 1518' until reaching the ending point 1518". While a clockwise configuration is generally shown in FIG. 15A for unzipping, other configurations may use a counterclockwise configuration for unzipping.

In FIG. 15B a dual zipper design is shown where starting points 1518A' and 1518B' each follow the tracks to respective ending points 1518A", 1518B" to open the respective pockets.

Figure 16A:
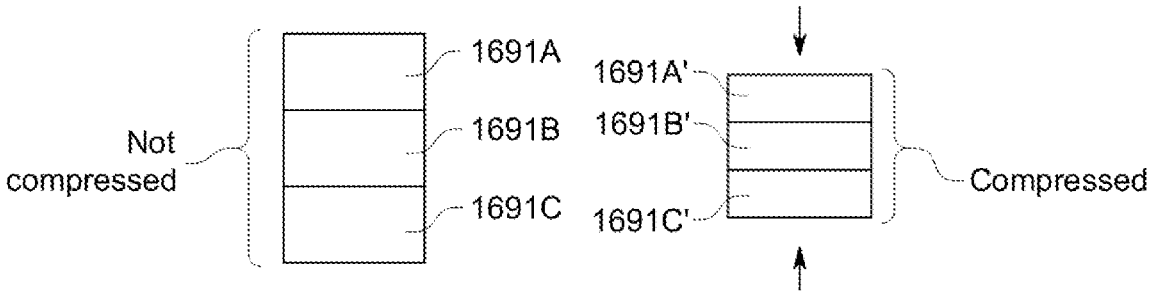
FIGS. 16A-16D show different box configurations for modules, according to embodiments of the disclosure.

FIGS. 16A-16D show different box configurations for modules, according to embodiment of the disclosure. FIG. 16A shows three uncompressed modules 1691A, 1691B, and 1691C on the left. The modules may be compressed as shown on the right and represented as modules 1691A', 1691B', and 1691C'. The compression of modules may reduce the shipping size according to particular configurations. In other non-limiting examples, more or less than 3 modules may be placed within the same box and/or packaging. As well, components other than modules from the middle and bottom layers may be placed within the same box, or within a box of its own.

Figure 16B:
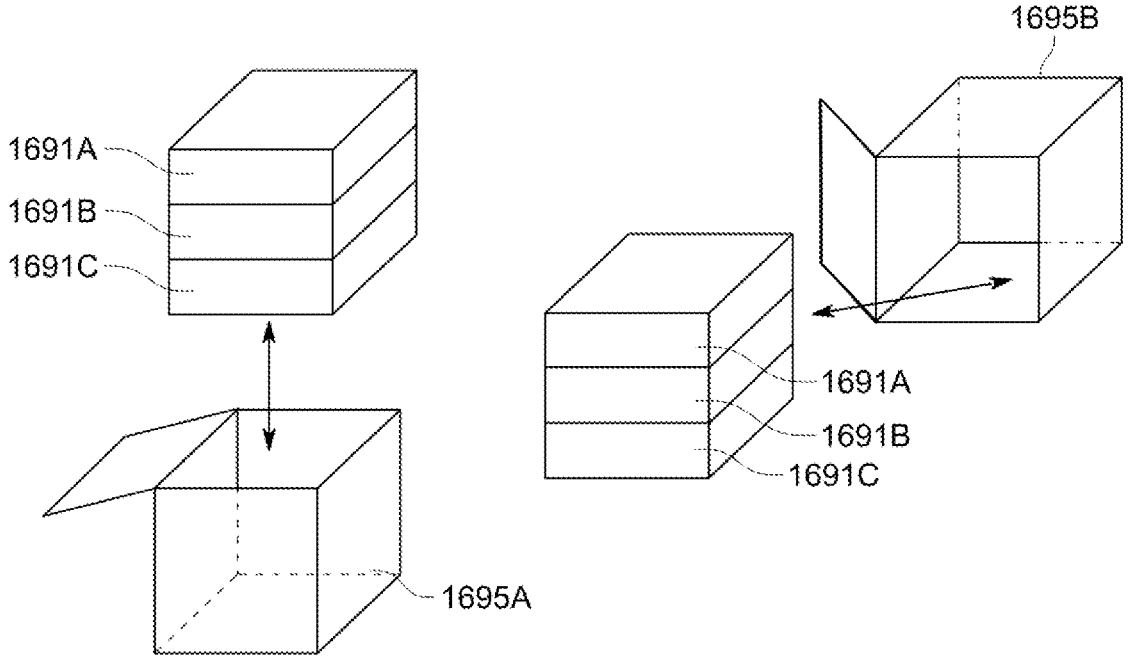

FIG. 16B shows examples of how modules can be placed inside the box from either the top or side. When the consumer opens the box, they may open it from the same side the modules were initially placed in. Alternatively, the modules may initially be placed inside the box from the top side, but taken out by the consumer from the side of the box. The box and/or packaging can be personalized on the interior and/or exterior. When the consumers receive their modular mattress system, the boxes can be personalized to each side of the bed, and each sleeper based on the modules and components chosen during the selection process, allowing for a personalized experience when receiving and setting up the mattress as couple. In particular configurations, the modules may be compressed in the box.

Figure 16C:
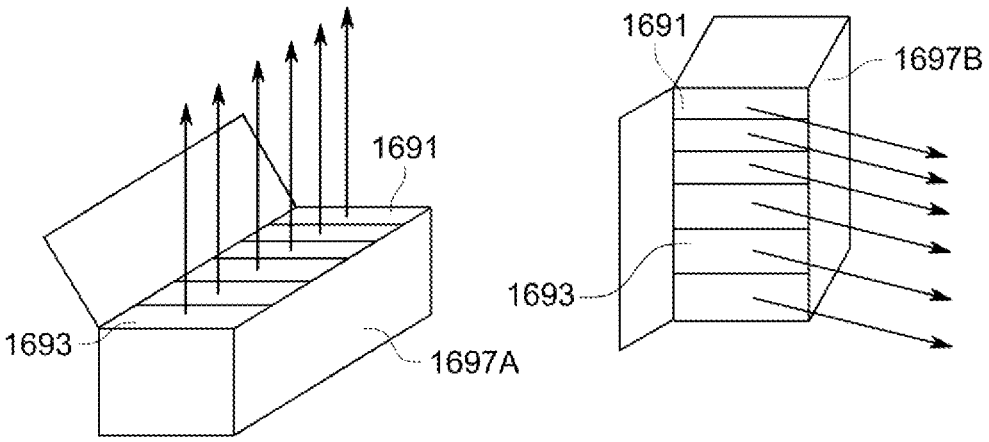

FIG. 16C shows examples of modules of different thicknesses being put in the same box. For example, each box 1697A, and 1697B includes three modules 1691 of one size and three modules 1693 of another size. The modules may otherwise have common dimensions of length and width and only differ in height. In placement or removal of the modules, the top (e.g., box 1697A) or side (e.g., box 1697B) may be used with respect to the boxes.

Figure 16D:
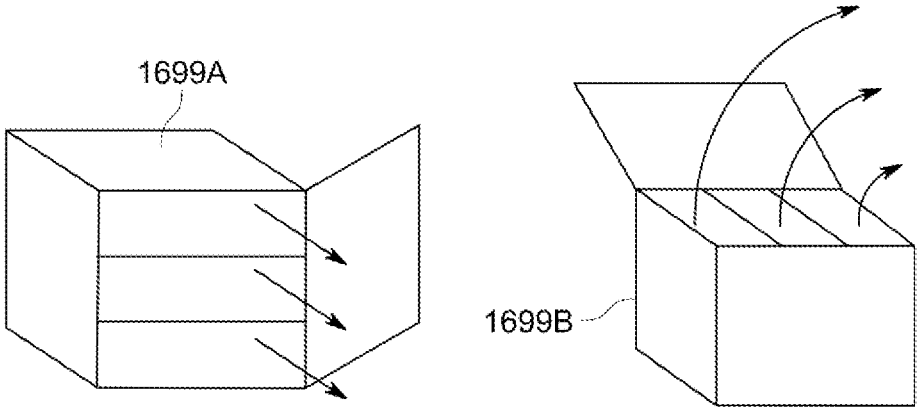

FIG. 16D shows modules of all the same size being removed from inside the box from the side (e.g., box 1699A) or top (e.g., box 1699B).

Figure 17A:
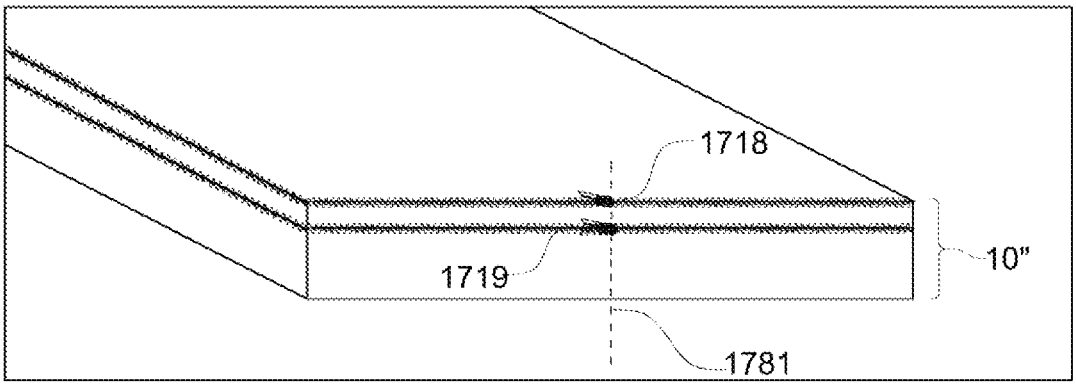
FIGS. 17A and 17B show an expandable portion of a bucket, according to an embodiment of the disclosure.
Figure 17B:
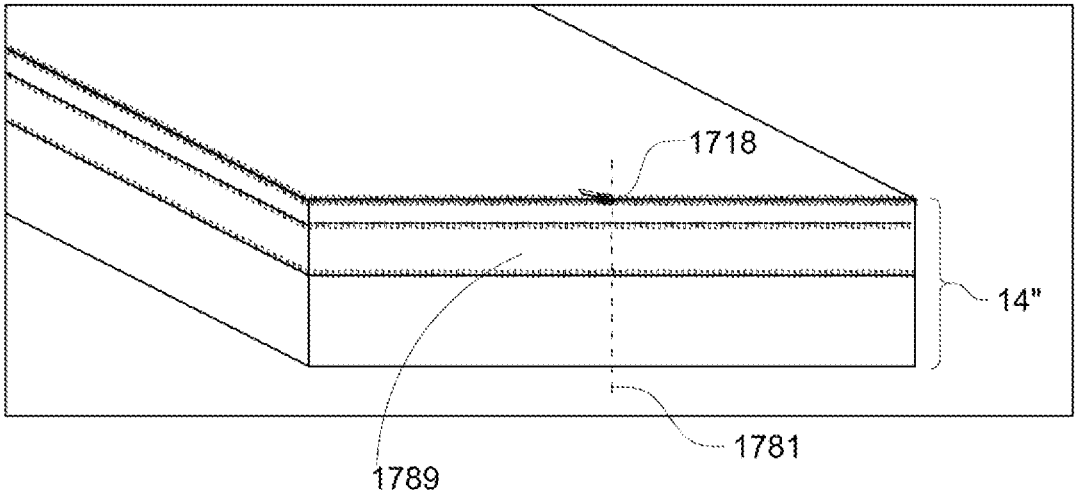

FIGS. 17A and 17B show an expandable portion of a bucket, according to an embodiment of the disclosure. In FIG. 17A, the zipper 1718, 1719 and corresponding tracks are shown as closed and a general height of 10 inches is shown. In FIG. 17B, an expandable area 1789 is shown to increase the height to 14 inches. While the examples of 10 inches and 14 inches are shown here, other sizes may be used in other configurations. The expansion area 1789 may be opened in a variety of manners. In FIG. 17B, two zipper tracks that were otherwise combined (e.g. in FIG. 17A) have now been unzipped in FIG. 17B. The zipper tracks shown may be a separate zipper from 1718. When unzipped, the bucket can expand in height, allowing room for additional modules or components to be added within the mattress system. By expanding the overall height and side profile of the bucket, the mattress is able to adjust and grow as the consumer does. The consumer no longer has to buy an entirely new mattress when new materials are released or developed, they can simply just unzip the top layer from the bucket, unzip the expandable portion on the bucket, and then add the new modules and/or components.

FIGS. 18A-18E show another variation in the top layer, sometimes referred to as the waterfall comfort layer, according to embodiments of the disclosure.

Figure 18A:
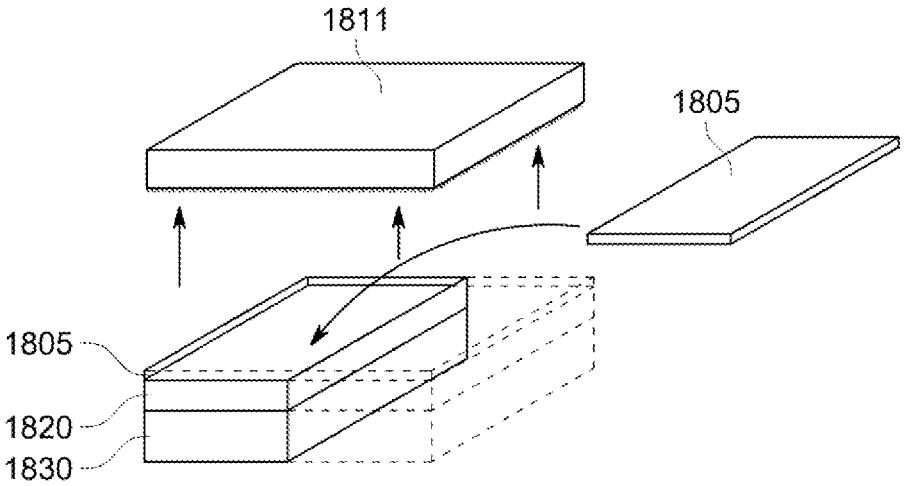
FIGS. 18A-18E show another variation in the top layer, sometimes referred to as the waterfall comfort layer, according to embodiments of the disclosure.
Figure 18B:
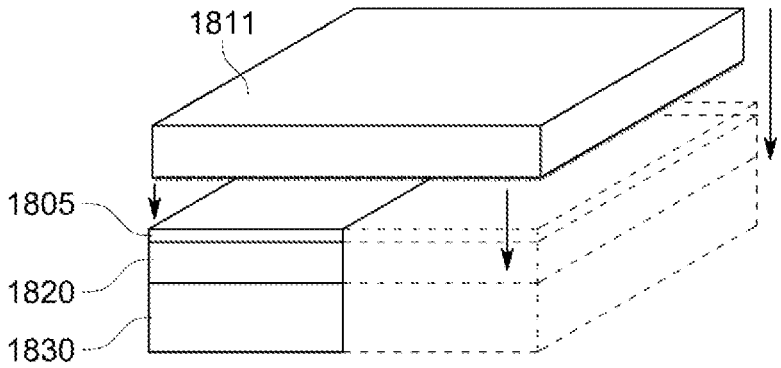

In FIGS. 18A and 18B, the modularized bottom layer 1830 and modularized middle layer 1820 are shown. In this configuration, a layer sometimes referred to as the relief layer 1805, is placed on top of the contour layer and within the bucket. The relief layer 1805 can be but is not limited to a material composition such as memory foam, latex, or a gel grid.

Figure 18C:
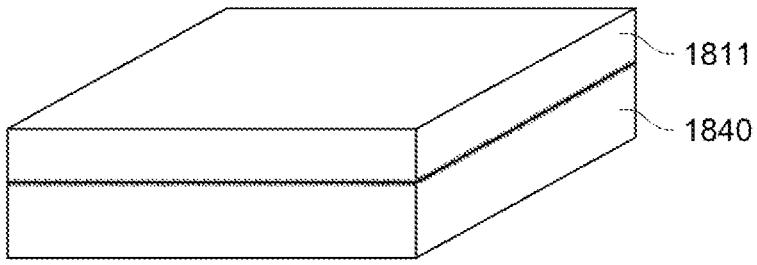

In FIG. 18C, the waterfall top layer 1811 is shown zipped to bucket 1840. In doing so, the material may extend over other layers in a waterfall type fashion.

Figure 18D:
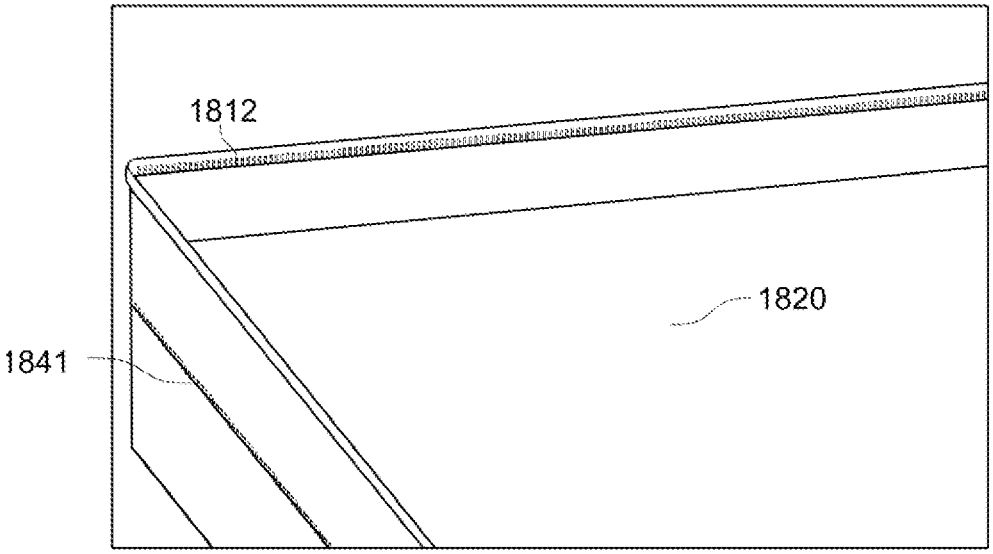

With reference to FIG. 18D, the middle layer 1820 is shown. Ordinarily, the top layer would then be placed on top of the contour layer and zipped closed. However, with the waterfall top layer 1811, the relief layer 1805 is placed on top of the contour layer. In some configurations, the relief layer is fastened to the interior side of the bucket. In FIG. 18D, this would be attached to zipper 1812. In other configurations, the relief layer is just placed on top and not fastened to the interior of the bucket before zipping the waterfall top layer to the side profile of the bucket 1840 by zipper 1841.

Figure 18E:
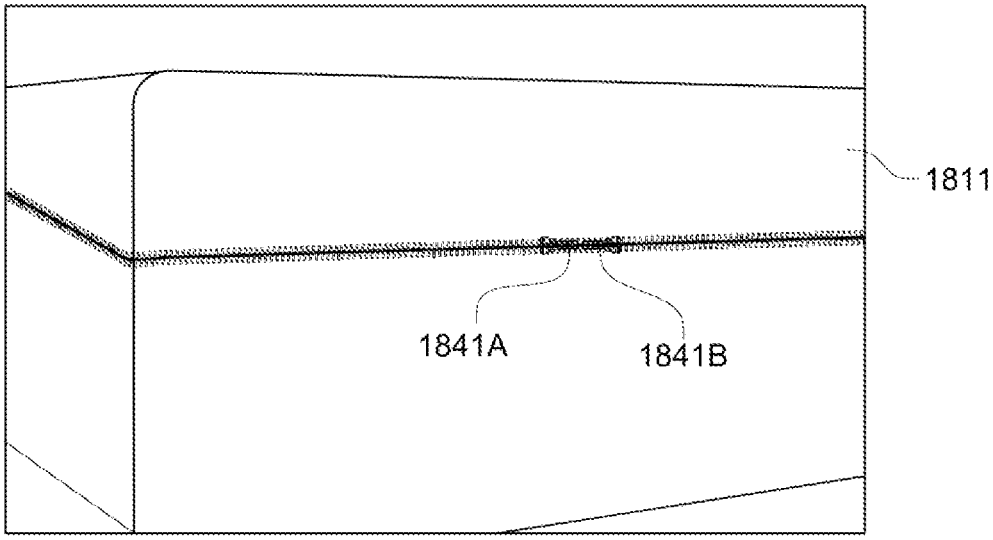

With reference to FIG. 18E, the waterfall top layer 1811 is shown being connected at a midway point on the eurobox 1840 with two zippers 1841A, 1841B that might zip and unzip in opposite directions around the mattress.

As compared to conventional mattress designs, the mattress design herein may have some, none, or all of the following advantages:

Modular Components and Layers: The modular mattress system empowers users with unparalleled customization options. Enclosed within the top layer(s) and bucket, the modular components and layers offer users adjustable firmness levels, diverse material compositions, and technological enhancements, ensuring tailored comfort and support. The innovative mattress design allows each sleeper to create their ideal sleeping environment, with customizable sides of the mattress tailored to that sleeper's unique needs, preferences, and sleeping habits. The modular mattress system facilitates versatility and customization, delivering a truly personalized sleep experience for every user.

Posturized Comfort: Utilizing the VCM evaluation and selection process, the modular mattress system offers personalized zoning for each side of the mattress, ensuring tailored comfort for individual sleepers within the same mattress system. By allowing for different material compositions and firmness levels in the shoulder, hip, and foot modules on each side of the mattress, sleep partners can now enjoy a personalized sleep experience that caters to their specific individual needs and preferences, eliminating the need to compromise on comfort.

Durability: The durability of the modular mattress system is enhanced by its ability to rotate, interchange, and exchange individual modules and layers. By incorporating a regular rotation schedule, users can ensure even distribution of wear and dispersal of fatigue points, extending the lifespan of each module and/or layer. This innovative feature not only promotes long-lasting comfort and support but also offers the convenience of easy maintenance and upkeep.

Sustainability: Sustainability lies at the core of the mattress system's design, facilitated by its modular construction that enables the replacement of individual modules and/or layers when necessary. This approach minimizes waste and extends the mattress's longevity by addressing wear and tear on a modular level, aligning with eco-conscious principles of resource conservation and environmental responsibility. By eliminating the need for discarding and purchasing an entirely new mattress, this system contributes to a more sustainable future. While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A mattress system comprising:

at least two layers, wherein at least one of the at least two layers is modularized such that the modularized layer includes at least a first module and a second module, the modularized layer extends from a foot of the mattress to a head of the mattress, the first module is closer to the head of the mattress than the second module, and the first module has a different characteristic than the second module, the different characteristic includes the first module having one or more types of material that are not contained in the second module;

the first module and the second module have a position within the modularized layer and, when located in the respective position, each of the first module and second module have:

an x-axis extending from an end of the respective first and second module that is closer to the head of the mattress to an end of the respective first and second module that is closer to the foot of the mattress, a y-axis orthogonal to the x-axis while sharing the same plane of the x-axis, and a z-axis orthogonal to the x-axis and the y-axis; and each of the first module and the second module configured to be modified after an initial use of the first module and the second modules with their respective position, the modification including one or more of:

being rotated, around the z-axis, within its position in the modularized layer, being flipped, around either the x-axis or the y-axis, within its position in the modularized layer, the flipping being independent of flipping the entire modularized layer or modules in the modularized layer lying along the x-axis corresponding to a side of the mattress system having two sides, being moved to a different position within the modularized layer, the movement being independent of flipping the entire modularized layer and modules in the modularized layer lying along the x-axis corresponding to a side of the mattress system that has two sides, and being moved to a different position within the mattress system outside the modularized layer, the movement being independent of flipping the entire modularized layer, flipping modules in the modularized layer lying along the x-axis corresponding to a side of the mattress system that has two sides, and flipping modules stacked in two layers; and wherein the rotation, flipping, or moving for the first module occurs on a schedule or a frequency that is different than a schedule or frequency for the rotation, flipping or moving for the second module.

2. The mattress system of claim 1, wherein the modification further includes being exchanged for a module not previously contained in the mattress system.

3. The mattress system of claim 1, wherein the modification occurs according to changed needs of one or more users of the modules.

4. The mattress system of claim 1, wherein:

the at least two layers are a contour layer and a support layer, and the first module and the second module have the same dimensions.

5. The mattress system of claim 4, further comprising:

a third layer, and a box, wherein at least a portion of the first layer, the second layer, or the third layer is contained in the box.

6. A mattress system comprising:

at least three layers, wherein at least one of the at least three layers is modularized such that the modularized layer includes at least a first module and a second module, the modularized layer extends from a foot of the mattress to a head of the mattress, the first module is closer to the head of the mattress than the second module, the first module has one or more types of material that are not contained in the second module, and the first module and the second module have a position within the modularized layer and, when located in the position, each of the first module and second module have:

an x-axis extending from an end of the respective first module and second module that is closer to the head of the mattress to an end of the respective first module and second module that is closer to the foot of the mattress, a y-axis orthogonal to the x-axis while sharing the same plane of the x-axis, and a z-axis orthogonal to the x-axis and the y-axis; and each of the first module and the second module configured to be modified after an initial use of the first module and the second modules in their respective position, the modification including one or more of:

being rotated, around the z-axis, within the position in the modularized layer, being flipped, around either the x-axis or the y-axis, within its position in the modularized layer, the flipping being independent of flipping the entire modularized layer or modules in the modularized layer lying along the x-axis corresponding to a side of the mattress system having two sides, being moved to a different position within the modularized layer, the movement being independent of flipping the entire modularized layer and modules in the modularized layer lying along the x-axis corresponding to a side of the mattress system that has two sides, and being moved to a different position within the mattress system outside the modularized layer, the movement being independent of flipping the entire modularized layer, flipping modules in the modularized layer lying along the x-axis corresponding to a side of the mattress system that has two sides, and flipping modules stacked in two layers; and wherein the rotation, flipping, or moving for the first module occurs on a schedule or a frequency that is different than a schedule or frequency for the rotation, flipping or moving for the second module.

7. The mattress system of claim 6, wherein the modularized layer includes at least three modules in one of the following:

in a configuration of the mattress system having two sides, each of the sides having at least one of the three modules, or in a configuration of the mattress system having two sides, all of the three modules on a single side.

8. The mattress system of claim 6, wherein the modularized layer includes at least four modules in one of the following:

in a configuration of the mattress system having two sides, at least two modules per side, or in a configuration of the mattress system having two sides, at least three modules on one side.

9. The mattress system of claim 6, wherein the modularized layer includes at least six modules.

10. The mattress system of claim 6, further comprising:

a box, wherein at least a portion of one of at least three layers is contained in the box.

11. The mattress system of claim 6, wherein the types of material for the first and second module are selected from the group consisting of polyfoam, gel, memory foam, latex, fibers, coils or springs, polyurethane foam, organic latex, materials for heating, materials for cooling, materials or components for massaging, materials or components for sound, and materials or components for monitoring, or combinations of the proceeding.

12. The mattress system of claim 6, wherein the modularized layer includes at least a third module, the third module has a different Variable Compression Measure (VCM) than the second module.

13. The mattress system of claim 11, wherein the modularized layer includes at least a third module, the third module has a composition of types of material that is proportionally different than a composition of types of material in the second module.

14. The mattress system of claim 6, wherein the first module contains foam and the second module does not contain foam.

15. The mattress system of claim 6, wherein the first module and the second module do not contain foam.

16. The mattress system of claim 15, wherein the first module is configured to be both flipped around either the x-axis or the y-axis within the position and rotated around the z-axis within the position in the modularized layer.

17. The mattress system of claim 6, wherein the modification to the first module further includes being exchanged for a module not previously contained in the mattress system.

18. The mattress system of claim 17, wherein the modification occurs according to changed needs of one or more users of the mattress system or changed technology or materials available for the module.

19. A mattress system comprising:

a first modularized layer and a second modularized layer, at least six modules dispersed between the first modularized layer and the second modularized layer, wherein:

each of the first modularized layer and the second modularized layer has at least three modules, three of the six modules are a first module, a second module, and a third module, at least one of the first module, the second module, and the third module is in a different modularized layer than the others of the first module, the second module, and the third module;

each of the first module, the second module, and the third module having a different characteristic than the others of the first module, the second module, and the third module, the different characteristic including having one or more types of material that are not in the others of the first module, the second module, and the third module;

the first module and the second module have a position within their respective modularized layer and, when located in the position, each of the first module and second module have:

an x-axis extending from an end of the respective first module and second module that is closer to a head of the mattress to an end of the respective first module and second module that is closer to a foot of the mattress, a y-axis orthogonal to the x-axis while sharing the same plane of the x-axis, and a z-axis orthogonal to the x-axis and the y-axis; and each of the first module and the second module configured to be modified after an initial use of the first module and the second modules in their respective position, the modification including one or more of:

being rotated, around the z-axis, within the position in the modularized layer, being flipped, around either the x-axis or the y-axis, within its position in the modularized layer, the flipping being independent of flipping the entire modularized layer or modules in the modularized layer lying along the x-axis corresponding to a side of the mattress system having two sides, being moved to a different position within the modularized layer, the movement being independent of flipping the entire modularized layer and modules in the modularized layer lying along the x-axis corresponding to a side of the mattress system that has two sides, and being moved to a different position within the mattress system outside the modularized layer, the movement being independent of flipping the entire modularized layer, flipping modules in the modularized layer lying along the x-axis corresponding to a side of the mattress system that has two sides, and flipping modules stacked in two layers; and wherein the rotation, flipping, or moving for the first module occurs on a schedule or a frequency that is different than a schedule or frequency for the rotation, flipping or moving for the second module.

20. The mattress system of claim 19, wherein the different characteristic further includes a different Variable Compression Measure (VCM) than the others of the first module, the second module, and the third module.

21. The mattress system of claim 19, wherein the different characteristic further includes a composition of types of material that is proportionally different than a composition of types of material in the others of the first module, the second module, and the third module.

22. The mattress system of claim 19, wherein:

another of the at least six modules is a fourth module, and the fourth module has a different characteristic than the first module, the second module, and the third module.

23. The mattress system of claim 19, further comprising:

a third modularized layer having at least two modules.

24. The mattress system of claim 19, wherein the mattress system has a first side and a second side, and the first module and the second module are on the same side.

25. The mattress system of claim 19, wherein the first module and the second module share a plane beginning a layer in the mattress system.

26. The mattress system of claim 19, wherein the at least six modules are the same size.

* * * * *